United States Patent [19]

Stäheli et al.

[11] Patent Number: 4,860,406

[45] Date of Patent: Aug. 29, 1989

[54] METHOD FOR DETECTING THE DENSITY OR THICKNESS AND VARIATIONS THEREOF OF FIBER MATERIAL AT THE INFEED OF A TEXTILE MACHINE AS WELL AS A METHOD FOR EVENING THE DENSITY OR THICKNESS VARIATIONS OF FIBER MATERIAL AT THE INFEED OF A TEXTILE MACHINE MACHINE

[75] Inventors: Paul Stäheli, Wilen b. Wil; Robert Demuth, Nürensdorf; Peter Fritzsche, Winterthur, all of Switzerland

[73] Assignee: Rieter Machine Works Ltd., Winterthur, Switzerland

[21] Appl. No.: 132,204

[22] Filed: Dec. 10, 1987

[30] Foreign Application Priority Data

Dec. 12, 1986 [CH] Switzerland ..... 04950/86

[51] Int. Cl.[4] ..... D01G 15/36; D01G 15/40

[52] U.S. Cl. ..... 19/105; 19/240

[58] Field of Search ..... 19/105, 240

[56] References Cited

U.S. PATENT DOCUMENTS

| | | | |
|---|---|---|---|
| 4,001,916 | 1/1977 | Grimshaw | 19/105 X |
| 4,271,565 | 6/1981 | Grunder | 19/240 |
| 4,275,483 | 6/1981 | Roberson | 19/240 |
| 4,438,548 | 3/1984 | Grunder | 19/105 |

FOREIGN PATENT DOCUMENTS

| | | |
|---|---|---|
| 1118068 | 11/1961 | Fed. Rep. of Germany . |
| 2050111 | 4/1971 | Fed. Rep. of Germany . |
| 3205776 | 8/1983 | Fed. Rep. of Germany . |
| 2379624 | 9/1978 | France . |
| 0956146 | 4/1964 | United Kingdom . |

*Primary Examiner*—Werner H. Schroeder
*Attorney, Agent, or Firm*—Werner W. Kleeman

[57] ABSTRACT

A fiber infeed device supplies fiber material to a textile machine, such as a card, and comprises a driven rotatable feed roll and feed plate. This roll is, however, spatially fixed, whereas the feed plate is pivotable but physically immobile during detection of the thickness and thickness variations of the infed fiber material. The feed plate can be pivoted into an operating position against a stop during throughpass of the fiber material. A substantially invariable size nipping zone is thus formed between the driven rotatable feed roll and the stationary feed plate in which a property of the throughpassing fiber material representative of its instantaneous thickness and thus variations thereof can be detected. By positionally fixing the feed plate, for instance, different forces are applied thereto in the nipping zone where the fiber material is compacted. The arising variable forces enable ascertaining thickness variations of the infed fiber material. A further aspect contemplates deriving from the variable forces control signals delivered to a control device for comparison with a predeterminate reference value signal to produce output signals for controlling the rotational speed of the feed roll and thus compensating thickness variations of the infed fiber material.

25 Claims, 19 Drawing Sheets

METHOD FOR DETECTING THE DENSITY OR THICKNESS AND VARIATIONS THEREOF OF FIBER MATERIAL AT THE INFEED OF A TEXTILE MACHINE AS WELL AS A METHOD FOR EVENING THE DENSITY OR THICKNESS VARIATIONS OF FIBER MATERIAL AT THE INFEED OF A TEXTILE MACHINE MACHINE

CROSS-REFERENCE TO RELATED APPLICATION

This application is related to our commonly assigned, co-pending U.S. Pat. application Ser. No. 07/132,274, filed Dec. 10, 1987 , and entitled "Method and Apparatus for Automatically Compensating Density or Thickness Variations of Fiber Material At Textile Machines, Such as Cards, Draw Frames, and the like".

BACKGROUND OF THE INVENTION

The present invention relates to a new and improved method of, and apparatus for, determining the density or thickness and thus determining or detecting the density and thickness variations of fiber material at the infeed or infeed side of a textile machine, such as typically although not exclusively, a carding machine or engine—also referred to in the art as simply a card. The present invention also relates to a new and improved method and apparatus for essentially evening or compensating the density or thickness variations of fiber material at the infeed or infeed side of a textile machine.

In the context of this disclosure the terms evening or compensating the "density" or "thickness" variations of the fiber or fibrous material, or equivalent expressions, are generally intended to mean essentially or substantially evening out or compensating such density or thickness variations or irregularities so that the fiber or fibrous material delivered by the textile machine possesses an essentially or substantially uniform weight per unit length or density.

Generally speaking, the method for determining the instantaneous density or thickness and thus detecting the density or thickness variations in the fiber or fibrous material at the infeed of a textile machine, such as a fiber batt or lap delivered to a carding machine or card, comprises deriving signals dependent upon the instantaneous density or thickness and thus the density or thickness variations of the fiber material at a fiber processing means, such as a fiber infeed or delivery means which delivers the fiber material to the infeed or infeed side of the textile machine.

According to a further aspect of the inventive method the detected signals, representative of the variations in density or thickness of the infed fiber material, can be exploited for evening or compensating the density or thickness variations of the fiber material, such as the batt or fiber lap or other form of fibrous material, such as a sliver, band or the like fed into the textile machine by the fiber infeed or delivery means.

Not only is the invention concerned with the aforementioned method aspects of, for instance, deriving signals representative of the density or thickness variations of an infed fiber material and, when desired, utilizing such signals for substantially evening or compensating the density or thickness variations of the infed fiber material, but also the invention pertains to a new and improved apparatus for the performance of the various method aspects.

In its broader aspects, the apparatus for accomplishing the method of detecting density or thickness variations of the infed fiber material comprises fiber infeed means containing at least one driveable feed roll for feeding the fibrous material to the textile machine. A fiber feed element, typically but not exclusively a fiber feed plate, coacts with this driven rotatable feed roll and forms therebetween a nipping zone or region or gap for the fiber material. Measuring or sensing means detect the fiber density or thickness variations prevailing in the nipping zone or region or gap—hereinafter usually simply referred to as the nipping zone or region—. When it is desired to correct the variations in the fiber density or thickness infed into the textile machine the measuring or sensing means can deliver the detected or derived measuring signals, representative or indicative of such fiber density or thickness variations, to a control device or control for the evening or compensation of the density or thickness variations of the infed fiber material.

Evening or compensation of the density or thickness of fiber material at the input or input side of a textile machine, it being noted that in the case of a card such fiber material is typically termed a fiber batt or lap, is an important prerequisite for the uniformity of the fiber product, again in the case of a card typically termed a web or sliver, delivered by the textile machine. This prerequisite or precondition assumes an even greater importance with increasing processing speeds of the textile machine because fewer machines are employed for the same quantity of fiber material, such as the batt or lap, which is to be processed, so that there is reduced the possibility of doubling throughout a larger number of machines.

Because of the importance of this problem there has evolved a considerable amount of patent documentation and literature proposing solutions attempting to fulfill such objectives. In the following description there will be enumerated, by way of example, a number of such patents.

For instance, in the U.S. Pat. No. 4,275,483, granted June 30, 1981, there is disclosed a fiber infeed means for a carding machine or card. The fiber infeed means comprises a stationarily arranged feed plate and a driven and movable feed roll arranged above the stationary feed plate. This driven and movable feed roll is pressed at both of its ends by means of springs against the fiber batt located between the driven and movable feed roll and the stationary feed plate.

The movements or displacements of the driven and movable feed roll, caused by the irregularities or unevenness in the fiber batt, are detected by displacement sensors or transducers provided at both ends of the driven and movable feed roll. These displacement sensors deliver signals representative of the irregularities in the fiber batt to a control device which computes therefrom the requisite change in the rotational speed of the driven and movable feed roll in order to compensate the unevenness or irregularity of the infed fiber batt as far as possible.

What is construed to be a notable shortcoming of this prior art system resides in the fact that the driven and movable feed roll, which infeeds the fiber material, is also used for sensing the unevenness of the fiber batt. This automatically leads to disturbances or deviations in the measuring signals, even then if measures are undertaken in the arrangement and construction of the drive system for the driven and movable feed roll in order to obtain directions of the drive forces at the driven and movable feed roll essentially perpendicular to the direction of movement of such driven and movable feed roll during the batt thickness sensing operation.

The aforementioned shortcoming or problem is considered to be eliminated by the apparatus disclosed in the French Pat. No. 2,322,943, published Apr. 1, 1977, which proposes using a stationary but rotatable feed roll and sensing the unevenness or irregularities of the infed fiber material, namely the batt or lap delivered to the card, by means of a movable feed plate structure or unit which is preferably composed of a plurality of contiguous pedals or plates. The feed plate structure or unit, and specifically the pedals or plates thereof are mounted to be pivotable or swivelable, so that they can move towards and away from the stationary but rotational feed roll, to thereby sense unevenness or irregularities in the infed fiber material or batt.

A shortcoming which is thought to exist in this prior art system does not pertain so much to the actual measuring principle involved, but to the manner of transfer of the fibers to a subsequent licker-in cylinder or roll. Due to the aforementioned pivotability of the trough-like feed pedals or plates in relation to the stationary licker-in cylinder or roll the fiber transfer position or location at the feed plates or pedals, moves or shifts. Consequently, the position of the fiber transfer location of the fiber batt from the feed plates or pedals to the licker-in cylinder or roll likewise alternately moves in the direction of rotation of the licker-in direction. This produces disturbances in the transfer of the fibers to the licker-in cylinder or roll.

A further state-of-the-art system which has been proposed, in order to eliminate or alleviate the initially explained drawbacks or shortcomings, has been described in the German Published Pat. No. 2,912,576, published Oct. 31, 1979. In this prior art apparatus a sensor element which is provided near to or bordering the stationary trough-like feed plate detects the density of the fiber batt which is in contact with the trough-like feed plate and delivers an appropriate signal to a control device in order to regulate the rotational speed of the feed roll.

What is perceived to be a shortcoming in this prior art system resides in the fact that the measurement of the density of the fiber batt occurs prior to entry thereof between the trough-like feed plate and the feed roll. This too early or incipient fiber density sensing operation allows for variations in the density of the fiber batt to still occur up to the point of entry of the fiber batt between the trough-like feed plate and the feed roll. These fiber density variations then no longer coincide with or are no longer faithfully represented by the measured values.

By way of clarification, it is here mentioned that fundamentally a trough-like feed plate and a feed plate constitute comparable or the same type of elements and a feed cylinder and a feed roll likewise constitute comparable or the same type of elements. Therefore in the context of this disclosure this equatability, as stated above, should be kept in mind and is intended to be encompassed by the disclosure and teachings of the invention set forth herein.

SUMMARY OF THE INVENTION

Therefore, with the foregoing in mind it is a primary object of the present invention to provide a new and improved method of, and apparatus for, determining or detecting the density or thickness as well as the density or thickness variations of fiber material infed or delivered to a textile machine in a manner which is not afflicted with the aforementioned drawbacks and shortcomings of the prior art.

Another and more specific object of the present invention aims at the provision of a new and improved method of, and apparatus for, detecting density or thickness variations of fiber material delivered to a textile machine, such that these fiber density or thickness variations can be reliably and accurately detected.

Still a further significant object of the present invention is directed to a new and improved method of, and apparatus for, detecting density or thickness variations of fiber material infed into a textile machine, not only in a highly accurate and reliable fashion, but without the need for utilizing fiber feed elements which are movable relative to one another and which thus distinctly visibly alter the size of the nipping zone or region during the fiber density or thickness variation detection operation.

In keeping with the immediately preceding object, it is another important object of the present invention to provide a new and improved method of, and apparatus for, ascertaining in a most reliable and accurate fashion variations in the density or thickness of fiber material delivered to a textile machine, by the provision of two coacting fiber processing or fiber feed elements, such as a feed roll and a feed plate defining a nipping zone or region therebetween of essentially invariable size throughout the fiber density or thickness detection operation.

Yet a further prominent object of the present invention aims at providing a new and improved method of, and apparatus for, the detection of density or thickness variations of fiber material delivered to a textile machine, wherein there is utilized during the density or thickness detection or measuring operation an essentially invariable size nipping zone or region through which the fibrous material moves, so that fluctuations or variations in the density or thickness of the fibrous material exert forces representative or indicative of such density or thickness fluctuations or variations in the fibrous material and which forces can be reliably sensed and detected and, when desired, exploited for essentially evening or correcting such density or thickness fluctuations or variations.

A further noteworthy object of the present invention aims at providing a new and improved method of, and apparatus for, evening the density or thickness variations of fiber or fibrous material delivered to a textile machine, such as a fiber batt or lap delivered to a carding machine or card.

A further pertinent object of the present invention aims at providing a new and improved method of, and apparatus for, ascertaining and controlling in a highly reliable and efficient manner the density or thickness, in other words, the weight per unit area, of fiber material, such as fiber material infed to a textile machine, to thereby control the production of the textile machine so that it delivers a product of essentially uniform weight.

Now in order to implement these and still further objects of the invention, which will become more readily apparent as the description proceeds, the method for detecting density or thickness variations of fiber material at the infeed to a textile machine, contemplates infeeding the fiber material to a fiber infeed device having, during the fiber density or thickness variation detection operation, a so-to-speak stationary nipping zone or gap, in other words, a stationary nipping zone or gap of predeterminate and essentially invariable or unchanging size. The fiber material is infed through the stationary nipping zone or gap and acts upon one of the elements of the fiber infeed device such that there is obtained a signal as a function of the density or thickness of the fiber material in the stationary nipping zone or gap. By obtaining a succession of these signals, which are each dependent upon or correlatable to the instantaneous or momentary density or thickness of the infed fiber material and which thus are indicative of variations or changes of the density or thickness of the infed fiber material, it is possible to reliably detect or sense such density or thickness variations.

At this juncture it is to be noted and appreciated that the terms "stationary nipping zone or region or gap", or equivalent expressions, as used herein are intended to encompass a nipping zone or region or gap through which there is infed the fibrous material whose density or thickness, and thus the density or thickness variations thereof are to be compensated or evened out. Such nipping zone or region can be construed to be stationary inasmuch as none of the fiber feed elements defining the nipping zone or region, such as the feed roll and feed plate are movable relative to or towards and away from one another, even though it is to be appreciated that the feed roll is a rotatable feed roll but otherwise constitutes a spatially fixed or immovable element. Stated in another way, the nipping zone or region is defined by two fiber feed elements which form therebetween such nipping zone or region which is of essentially invariable or unchanging size during the density or thickness variation detection operation. Irrespective how the nipping zone or region is defined, what is important is that during the time that there occurs the detection of the density or thickness variations of the infed fiber material, the elements defining or bounding such nipping zone or region do not move relative to one another to alter the size or dimensions of the nipping zone or region as is contemplated in prior art systems typically as described heretofore, where there is intentionally detected through the provision of suitable expedients alterations or variations in the actual size of the nipping zone or region by sensing or detecting discernible movements of one of the elements defining or bounding the nipping zone or region relative to the other element.

In a preferred embodiment of the method the fiber infeed means utilizes a stationary or spatially fixed but rotatably driven feed roll, in other words a feed roll which is simply driven to perform rotational movements but cannot otherwise alter its posture or spatial orientation. This stationary and rotatable feed roll coacts with a feed plate, which although preferably pivotably mounted, is in fact and must be immobile or stationary during the actual detection of the fiber density or thickness and variations thereof of the throughpassing fiber material in order to obtain useful measuring signals. The immobility of the feed plate is imparted thereto by, for instance, continually or continuously biasing such feed plate against a stop or abutment so that during the afore-explained detection operation this feed plate constitutes a stationary feed plate. There is thus formed the aforenoted stationary or essentially invariable or fixed-size or unchanging size nipping zone or region through which the fiber material moves. In a preferred embodiment, the throughpassing fiber material exerts forces upon the immobile feed plate during the fiber thickness sensing or detection operation and these forces are sensed or detected at appropriate measuring or sensing elements, typically strain gauges, which produce signals representative or indicative of the density or thickness fluctuations or variations of the infed fiber material.

In order to even out or compensate the density of the fiber material at the infeed to the textile machine, the thus obtained signals can be advantageously delivered to a 1 suitable control device which produces a control signal or signals for appropriately controlling the rotational speed of the spatially fixed but rotatable feed roll to even out the detected density or thickness variations or irregularities.

Other possibilities exist, as will be explained more fully hereinafter, to detect variations in the density or thickness of the infed fiber material by using the unique essentially invariable or unchanging size nipping zone or region defined by the coacting feed elements. For instance, there can be sensed alterations in the throughflow of a pressurized fluid medium, typically air flowing through the compressed fiber material in the nipping zone or region, which are then indicative of variations in the density or thickness of the throughflowing fiber material. Another technique which can be beneficially used is to detect, with the aforedescribed essentially invariable or unchanging size nipping zone or region, the forces exerted by the throughpassing fiber material upon one or more force measuring cells provided at one of the feed elements, thus providing an indication of alterations in the density or thickness of the throughpassing fiber material.

As already heretofore explained, the invention is not only concerned with the aforementioned method aspects but also pertains to a new and improved construction of apparatus for detecting density or thickness variations of the fiber material at the infeed of a suitable textile machine, such as typically although not exclusively, a carding machine or card. To that end density or thickness detection apparatus of the present development is manifested by the features that there is provided a fiber infeed means to which there is delivered the fiber material. The fiber infeed means comprises two coacting fiber infeed elements or fiber infeed components. One of the fiber infeed elements or fiber infeed means can be constituted by at least one driveable or driven rotatable feed roll for delivering the fiber material to a downstream located textile machine. Coacting with the at least one driveable or driven feed roll is a fiber feed plate. The at least one driveable or driven fiber feed roll and the feed plate, during the fiber density or thickness detection operation, define therebetween a stationary nipping zone or region, in other words, a nipping zone or region of essentially invariable or unchanging size, through which the fiber material passes. The throughpassing fiber material acts upon at least one of the fiber infeed elements or components in the stationary or essentially invariable size nipping zone or region such that the variations in the density or thickness of the fiber material passing therethrough are detected by suitable measuring or sensing elements responsive to the action of the throughpassing fiber material upon such one fiber infeed element or component which together with the other fiber infeed element or component forms the stationary or essentially invariable or unchanging size nipping zone or region.

According to a preferred embodiment of the invention the one fiber infeed element or component is constituted by a preferably pivotable feed plate which, however, during the actual fiber density or thickness detection operation, is continually or continuously urged against a stop or abutment by the action of the throughpassing fiber or fibrous material. This throughpassing fibrous material exerts forces on the immobile feed plate which are sensed by suitable measuring or sensing elements, typically strain gauges, to produce signals representative or characteristic of the density or thickness variations in the throughpassing fiber material which moves through the stationary or essentially invariable or unchanging size nipping zone or region.

These signals representative of the density or thickness variations in the throughpassing fiber material can be delivered to a suitable control device or control which produces appropriate control signals for controlling the rotational speed of the driven but stationary feed roll so as to even out or compensatingly control the detected density or thickness variations of the infed fiber material.

It should be appreciated that through the practice of the method and through the provision of apparatus constructions useful for the performance thereof, there can be reliably detected with extreme accuracy the density or thickness and variations thereof of the fiber material without being confronted with the aforementioned drawbacks or shortcomings of the prior art.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
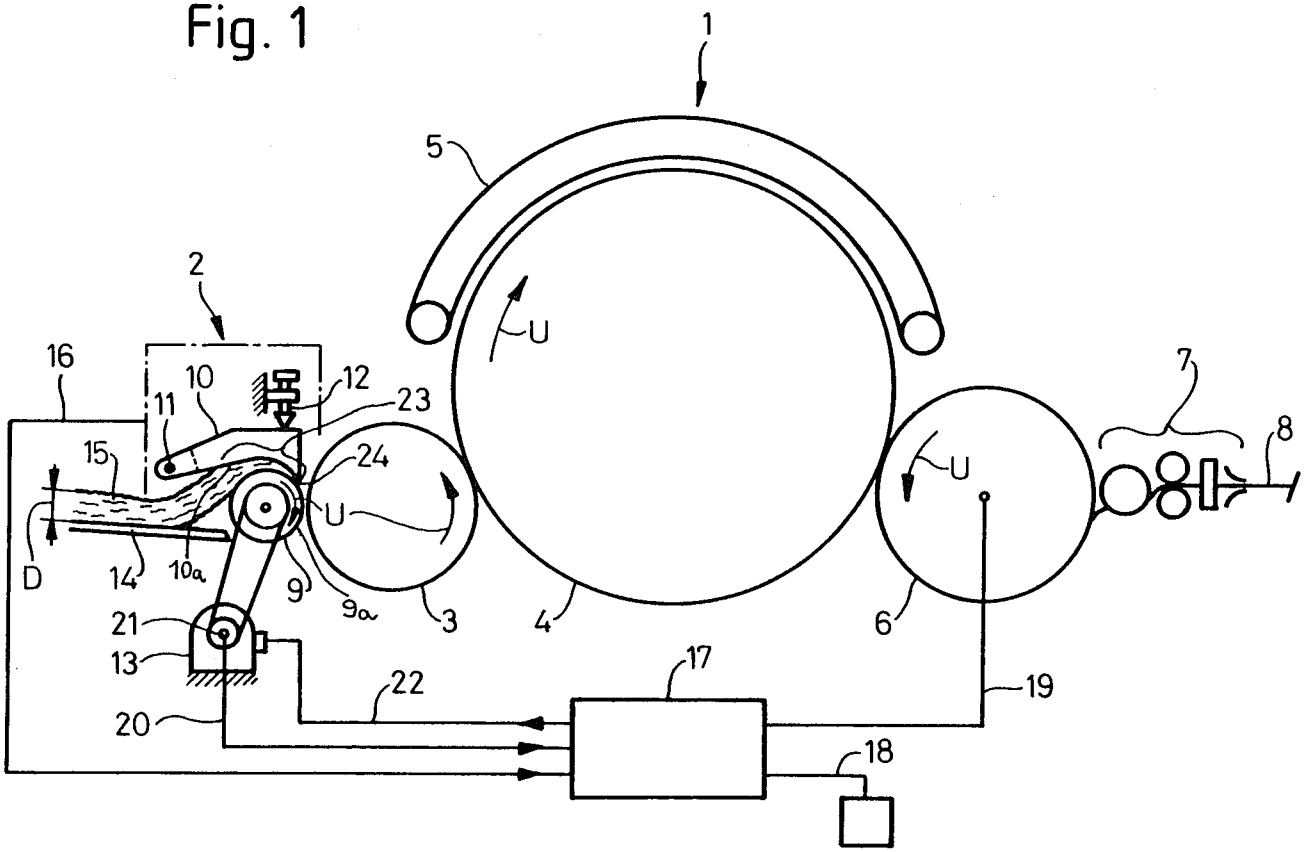
FIG. 1 is a schematic longitudinal sectional view of a textile machine, here a carding machine or card, equipped with fiber infeed means constructed according to the present invention.

Describing now the drawings, it is to be understood that for purposes of simplification of the illustration thereof, only enough of the apparatus for detecting the density or thickness and thus the density or thickness variations of fiber material at the infeed of a suitable associated textile machine and details of the construction of such associated textile machine, have been portrayed in the drawings as are needed to enable those skilled in the art to readily understand the underlying principles and concepts of the present development. Turning attention now to FIG. 1 of the drawings, there has been illustrated therein only by way of example and not limitation, as a possible type of textile machine with which the density or thickness detecting apparatus can be beneficially used a carding machine or card 1. This carding machine or card 1 will be seen to comprise, looking from the left to the right of the showing of FIG. 1, at the card inlet a fiber processing means, here a fiber infeed means or device, generally indicated in its entirety by reference numeral 2, and various embodiments of which will be discussed in detail in conjunction with other figures of the drawings, as well as a licker-in cylinder or roll 3, a main carding cylinder 4 provided with suitable carding flats 5 or the like, a doffer cylinder 6, also referred to in the art as a doffer roll, and a fiber web condensing unit or condenser 7 for forming a card sliver 8.

The fiber infeed means or fiber infeed device 2 comprises two coacting fiber feed or infeed elements or components 9 and 10. One of these coacting fiber feed elements 9 and 10, here the fiber feed element 9, comprises a driveable or driven rotatable feed roll or roller 9, also referred to sometimes in the art as a feed cylinder. The other coacting fiber feed or infeed element 10 coacting with the rotatable feed roll 9, is here constituted by a fiber feed plate 10, also sometimes referred to in the art as a trough-plate or trough-like feed plate. This fiber feed plate 10 is pivotably mounted for swivel or pivotal motion about a pivot shaft or axis 11. It is to be understood, however, that during the actual detection of the density or thickness and thus variations in the density or thickness—hereinafter usually simply conveniently referred to as thickness variations—of the infed fiber material 15, here shown as a fiber batt or lap, the pivotably mounted feed plate 10 is in fact stationary or immobile. This will be explained shortly in greater detail.

The feed roll 9, although constituting a rotatably or rotatable driven feed roll, is otherwise stationarily or fixedly arranged, in other words is spatially fixed in relation to the feed plate 10 during the detection of the fiber thickness and its variations of the infed or incoming fiber batt or lap 15. Since, as explained, the feed plate 10 is stationary during the actual fiber thickness variation detection operation there is provided a suitable, preferably adjustable stop or abutment 12 against which this pivotable feed plate 10 is forced, for instance, by the incoming batt or lap 15 during the measurement of the thickness and thickness variations of such incoming batt or lap 15. This stop or abutment 12 can be constituted, for instance, by a suitable adjustment screw or equivalent element against which there is firmly contactingly forced the feed plate 10 in a direction away from the feed roll 9 by the throughpassing batt or lap 15.

In this way there is formed a stationary fiber throughpass zone or nipping zone or region 23, in other words a nipping zone or region 23 of essentially invariable or unchanging size, between the thus or otherwise appropriately immobilized feed plate 10 and the rotatable but spatially fixed feed roll 9 during throughpassage of the batt or lap 15 between this stationary feed plate 10 and the rotatably driven feed roll 9. Stated another way, the outer surface or circumference 9*a* of the rotatably driven but spatially fixed feed roll 9 forms a first nipping surface which coacts with the confronting surface 10*a* of the stationary or immobilized feed plate 10 which forms a stationary nipping surface. The feed plate 10 is only here pivotably mounted to allow it to move towards the rotatably driven feed roll 9 in the event of depletion of the incoming batt or lap 15 or should the same fall below a predeterminate minimum thickness, in which event the otherwise immobilized feed plate 10 then can move, downwardly in the showing of FIG. 1, towards the rotatably driven feed roll 9 against a further stop or abutment, such as the stop or abutment 27 depicted in FIGS. 2 and 4, as will be explained more fully hereinafter. This stationary nipping zone or region 23 is here shown to possess, for instance, a substantially wedge-shaped converging configuration in the direction of travel of the mass of fiber material 15.

The rotatably driven feed roll 9 can be driven by any suitable drive means or drive motor, for instance, the gearing or transmission motor 13 as is well known in this technology.

During operation of the equipment or system, the fiber infeed means or device 2 has delivered thereto the fiber material, here the batt or lap 15 as the same moves along an infeed plate or plate member 14 or equivalent fiber material supporting structure. Due to the rotation of the rotatably driven feed roll 9 in the rotational direction U, and as is well known in this art, the fiber batt or lap 15 is delivered in the form of a compressed batt or lap to the licker-in cylinder or roll 3 which rotates at an appreciably greater rotational speed.

The fiber material which is processed between the main carding cylinder 4 and the carding flats 5 is removed by the doffer cylinder or roll 6 and delivered to the fiber web compaction device 7 in which the fiber web is compacted to form a card sliver or web 8. The ratio of the circumferential velocity of the doffer cylinder 6 with respect to the circumferential velocity of the rotatably driven feed roll 9 constitutes the so-called drafting ratio of the carding machine or card.

Moreover, in the exemplary embodiment under discussion due to the initial infeed of the fiber batt or lap 15 the feed plate 10 is pivoted away from the feed roll 9 to such an extent until this feed plate 10 firmly abuts against the stop or abutment 12, here depicted as the adjustable stop or abutment screw or equivalent structure. This position of the feed plate 10 where it is essentially immobilized against any further upward movement, will be conveniently referred to as the operating position of the thus immobilized or stationary feed plate 10.

With the aid of the adjustable abutment screw 12 or the like there can be determined the desired degree of compaction of the batt or lap 15 which is located between the thus immobilized or stationary feed plate 10 and the rotatably driven but spatially fixed feed roll 9, in other words the fiber batt compaction in the nipping zone or region 23. Through the provision of the adjustable stop or abutment 12 the desired size or dimensions of the nipping zone or region 23 can be initially set in accordance with the nature and properties of the mass of the fiber material which is intended to be processed.

The nipping or clamping action which is exerted by the nipping surfaces 9*a* and 10*a* of the feed roll 9 and stationary feed plate 10, respectively, in the essentially invariable or unchanging size nipping zone or region 23 located between these elements 9 and 10 and extending over the machine cross-width or length of such elements 9 and 10 produces, as will be described more fully hereinafter, detectable or measurable values representative of the density or thickness variations of the infed batt or lap 15 at the fiber infeed means 2, by means of which there can be continuously obtained a signal or sequence of signals 16, each representative of the instantaneous or momentary density or thickness of the so-to-speak "clamped" fiber batt or lap 15.

The signal 16 or, as the case may be, an average value of each of the thus momentarily obtained signals 16, for instance derived at opposite ends of the feed plate 10 as will be considered more fully hereinafter, is fed to a suitable control device or control 17 which appropriately processes the inputted signals 16. The invention is particularly concerned with the manner of deriving the signal or signals 16 representative of the thickness and thickness variations of the infed batt or lap 15 through the use of the elements 9 and 10 and not specifically with any particular manner of processing such signals in a control device, such as the control device 17, in order to control the rotational speed of the feed roll, 9, since such is basically well known in this technology. To that end the control device 17 will only be considered to the extent needed for those skilled in the art to readily understand how each or selected ones of the uniquely derived signals 16 could be processed for controlling the rotational speed of the rotatably driven feed roll 9. In the arrangement shown, apart from the signals 16 which are inputted to the control device 17 there is also delivered thereto a set or reference value or set point signal 18 representative of the desired batt thickness, a rotational speed signal 19 representative of the rotational speed of the doffer cylinder or roll 6 and a rotational speed signal 20 representative of the rotational speed of the shaft 21 of the gearing or transmission motor 13 controllably driving the feed roll 9. The batt thickness set point or reference value or signal 18 and the rotational speed signal 19 of the doffer cylinder or roll 6 constitute predeterminate set or reference values.

The control device 17 appropriately processes the aforementioned inputted signals so as to derive output or control signals 22, by means of which the rotational speed of the gearing or transmission motor 13 can be controlled. As is well known in this technology, each of the output or control signals 22 control the rotational speed of the drive motor 13 for the rotatably driven feed roll 9 in accordance with deviations or variations in the density or thickness of the fiber batt or lap 15 in the nipping zone or region 23 in such a manner that the rotatably driven feed roll 9 corrects the thickness or density variations of the batt or lap 15 such that these variations are essentially evened out or compensated upon departure of the batt or lap 15 from the nipping zone or region 23.

Although, as stated, control devices for controlling the rotational speed of a driven feed roll are well known in this art there will be explained, by way of example, and not limitation, a possible construction of the essential components of the control device 17. This control device 17 may basically comprise a commercially available microcomputer, type 990/100MA, readily available from the well known firm Texas Instruments and equipped with a required number of EPROM's likewise commercially available under the type designation TMS2716 from Texas Instruments for programming desired control functions. The control device 17 also contains a commercially available regulator procurable under the designation type D 10 AKN RV 419D-R from the West German firm AREG Corporation, located at Gemrigheim, West Germany, this regulator amplifying the signals delivered by the microcomputer so as to produce the output or control signals 22 as a function of the rotational speed signal 20 delivered thereto. These output or control signals 22, as explained, serve for the continuous control and regulation of the rotational speed of the feed roll 9. Since in the depicted exemplary embodiment the control device 17 does not take into account the weight of the card sliver or web 8 at the output or exit side of the carding machine the system in question is a so-called open loop control system. However, a closed loop control system with error feed forward can be equally used and is disclosed in the aforementioned commonly assigned, co-pending U.S. Pat. application Ser. No. 07/132,274, filed 12/10/87, and entitled "Method and Apparatus for Automatically Compensating Density or Thickness Variations of Fiber Material At Textile Machines, Such as Cards, Draw Frames and the Like", to which reference may be readily had and the disclosure of which is incorporated herein by reference. Also prior known closed loop system, but with a quite different fiber infeed device for detecting thickness variations or fluctuations, has been previously used on a commercially available Rieter card of the assignee of the instant application, commercially available in the market as the Rieter C-4 card and such type of control or control system can be readily modified for use in the exemplary open loop control system of the present invention if there is only desired an open loop control operational mode. Also as will be evident to those skilled in the art there could also be used an electrical control instead of an electronic control.

Continuing, it should be evident that the nipping zone or region 23 is defined by the coaction of the feed roll 9 and the feed plate 10 in that in this wedge-shaped converging nipping zone or region 23 the infed batt or lap 15 is compressed from its original thickness D to a lesser thickness which such compressed batt or lap 15 possesses directly prior to departure from the nipping zone or region 23. The nipping zone or region 23 thus terminates at a location of narrowest size at the region of the edge or nose of the feed plate 10, designated as the fiber delivery or release edge or nose or nose member 24, where the batt or lap 15 is no longer clamped or nipped by the stationary feed plate 10.

The direction of rotation of each of the rotatably driven feed roll 9, the licker-in cylinder 3, the main carding cylinder 4, and the doffer cylinder 6 have each been conveniently designated by the associated arrow U. The fiber material travels through the carding machine or card in accordance with the direction of rotation U of the aforementioned individual components or elements 9, 3, 4 and 6.

As will be recalled, the invention is particularly concerned with the manner of constructing the fiber infeed means or device and using the same so as to be able to derive thickness signals 16 representative of fluctuations or variations in the density or thickness in the infed fiber material, such as the fiber batt or lap 15, for instance delivered to the carding machine depicted in FIG. 1. Now in FIG. 2 there has been illustrated on an enlarged scale and in somewhat greater detail the fiber infeed means or device 2 of the textile machine, namely the exemplary card of the arrangement of FIG. 1, wherefore the same elements or components have been generally conveniently designated with the same reference characters.

Figure 2:
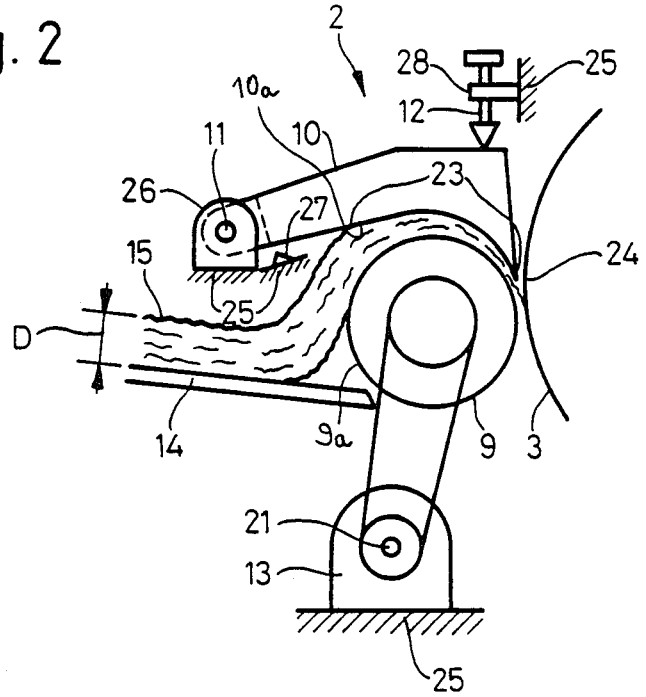
FIG. 2 illustrates on an enlarged scale and in detail the fiber infeed means of the arrangement depicted in FIG. 1.

By inspecting FIG. 2 it will be apparent that the there depicted pivot shaft or axis 11 for the feed plate 10 is mounted in a stationary bearing housing 26 which is part of the machine housing 25, only schematically depicted in such FIG. 2. It is of course to be appreciated that the feed plate 10 is preferably mounted at opposite ends or sides thereof at a related pivot shaft or journal 11 (see also FIGS. 34 and 35) in an associated stationary bearing housing 26 at each such opposite end of the feed plate 10, but as shown in the drawings by way of example a single throughpassing pivot shaft 11 also can be used.

Furthermore, at the machine housing 25 there is secured a stop or impact member or abutment 27, as previously mentioned, which prevents the feed plate 10, when the fiber batt or lap 15 has depleted or has a thickness below a permissible thickness, from dropping onto and undesirably coming into contact with the rotatably driven feed roll 9.

Equally apparent in the showing of FIG. 2 is a mounting or support element 28 for receiving the preferably adjustable stop or abutment member 12, here the adjusting or adjustment screw 12. The drive motor 13, here the gearing or transmission motor, for the rotatably driven feed roll 9 is likewise secured at the machine housing 25, as has been shown in FIG. 2.

Figure 3:
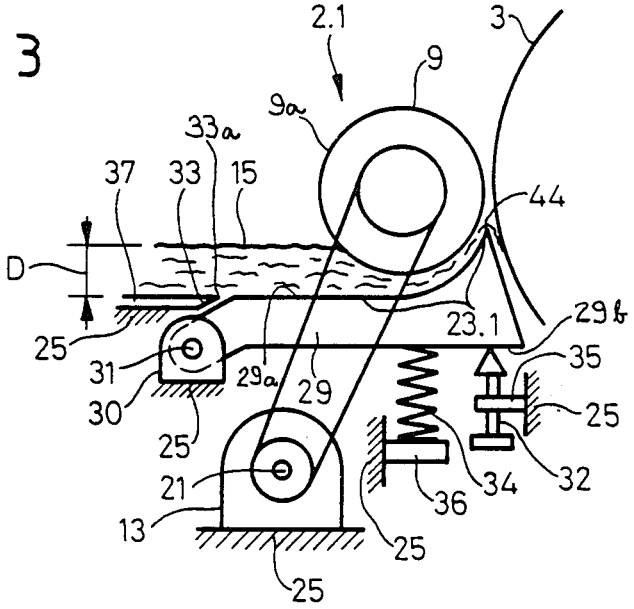
FIG. 3 illustrates a variant construction of the fiber infeed means of the embodiment of FIG. 2.

In FIG. 3 there is depicted a variant embodiment of the fiber infeed means or device 2.1 from that shown with reference to FIGS. 1 and 2 previously discussed, so that again the same or analogous elements or components have been generally conveniently designated with the same reference characters. This modified construction of the fiber infeed means or device 2.1, as observed by inspecting FIG. 3, will be seen to comprise a feed plate 29 having a nipping surface **29*a* and which, however, in this case is arranged below the rotatable driven feed roll 9. The feed plate 29 is pivotably mounted by means of a pivot shaft or axis 31 in a bearing housing 30 secured at the machine housing 25**.

In this case, the stop or abutment 32 is constituted by an adjusting or adjustment screw engaging with the lower face or surface **29*b* of the feed plate 29. This adjusting or adjustment screw 32 or equivalent structure limits the pivotal movement of the feed plate 29 in a direction away from the coacting feed roll 9. A further stop or abutment 33 prevents the feed plate 29 from moving in the direction towards the feed roll 9 and undesirably coming into contact with this feed roll 9. This possible motion of the feed plate 29 upwardly towards the feed roll 9 can be precipitated by the compression or pressure spring 34 which is here likewise provided as a safety feature to urge the feed plate 29 towards but not into contact with the feed roll 9 in the event of depletion or undesirable thickness reduction of the fiber material 15**.

The adjusting or adjustment screw 32 is mounted by means of a suitable mounting or support element 35 carried by the machine housing 25. Equally, the compression or pressure spring 34 is supported by a mounting or support element 36 likewise carried by the machine housing 25.

The aforementioned stop or abutment 33, in this case, is constituted by the end surface **33*a* of the fiber infeed plate 37 which likewise is appropriately attached at the machine housing 25. In this embodiment the region of the nipping zone or region 23.1 corresponds to the region of the nipping zone or region 23 depicted with reference to FIGS. 1 and 2**.

In the description to follow there will be considered with reference to further figures of the drawings the measuring or sensing expedients or means which can be advantageously employed in order to generate the signals 16 delivered by the fiber infeed means or the fiber infeed device 2 or 2.1 heretofore considered.

At this point it is remarked that FIGS. 4, 8, 12 16, 20 and 24 depict elements of the fiber infeed means or device 2 of the arrangement of FIG. 2, whereas FIGS. 6, 10, 14, 18 and 22 depict elements of the fiber infeed means or device 2.1 of the modified embodiment of FIG. 3. Therefore, in the aforementioned figures of the drawings there have again been generally conveniently used the same elements to designate the same or analogous components.

Figure 4:
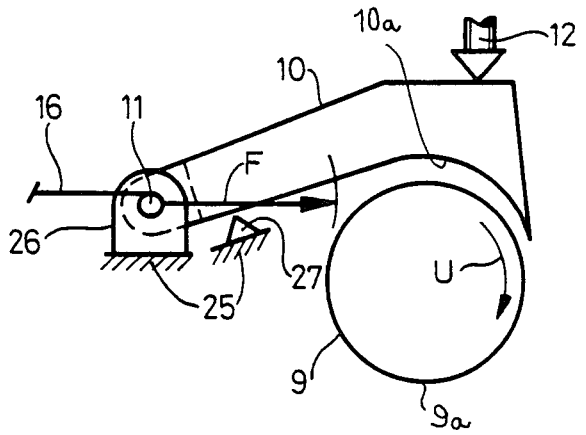
FIG. 4 illustrates on an enlarged scale parts of the fiber infeed means of the arrangement of FIG. 1.
Figure 5:
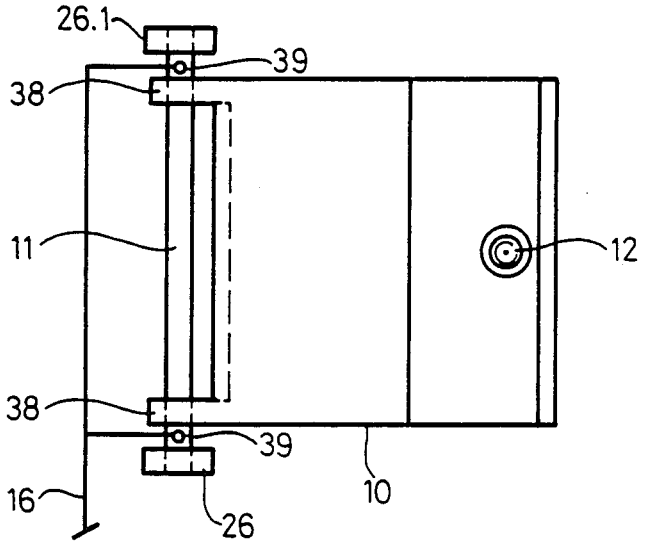
FIG. 5 is a top plan vie of the arrangement depicted in FIG. 4.

From the illustration of FIG. 5, which is a top plan view of the construction of fiber infeed means or device depicted in FIG. 4, it will be seen that there is provided the feed plate 10, the pivot shaft or axis 11 and the bearing housing 26 as well as a second bearing housing 26.1 at the opposite end or side of the feed plate 10 which likewise receives the associated pivot shaft or axis 11, as has been previously considered when explaining the arrangement of FIG. 2. In the arrangement shown by way of example in FIG. 5 there is depicted a single throughgoing pivot shaft 11, by way of example.

The feed plate 10 possesses two bearing brackets or collars 38 by means of which the feed plate 10 can be pivotably mounted at its opposite ends at the pivot shaft or axis 11. In the intermediate space between the bearing brackets or collars 38 and the bearing housing 26 and 26.1, respectively, the pivot shaft or axis 11 is provided with a respective surface 39, as also particularly well seen by referring to FIGS. 34 and 35. At each such surface 39 located at opposed ends of the feed plate 10 there is mounted an associated sensing or measuring element, here a strain gauge 90. These strain gauges 90 are arranged in such a manner that the strain gauges 90 arranged at opposite ends of the feed plate 10 each generate a signal in accordance with the magnitude of a force F (as shown in FIGS. 4, 33 to 35) which momentarily arises during thickness variation detection operation due to the action of the fibrous material, such as the batt or lap 15 acting upon the feed plate 10. Both of these derived signals detected or sensed at the strain gauges 90 then can be conventionally converted in an appropriate average or mean value former so as to obtain the previously mentioned signals 16 representative of the momentary thickness and thickness variations or fluctuations of the infed fiber material 15.

It is to be understood the force F is composed of two force components, and specifically, on the one hand, a force component which emanates from the compression or pressure forces generated by the so-to-speak spring-action of the fibrous material, for instance the fiber batt or lap 15, in the nipping zone or region 23 between the feed plate 10 and the feed roll 9 and, on the other hand, a force component which results from the frictional forces arising in the nipping zone or region 23 by virtue of the movement of the throughpassing fiber material.

The optimum direction of the force F can be determined empirically and this is possible by determining, for instance, at what orientation of the strain gauges 90 the same will generate the greatest response signal. It is, however, here noted that an approximation to such optimum direction is generally sufficiently accurate for thickness variation detection purposes. It has been found that an orientation of the strain gauges 90 so as to essentially lie in a horizontal plane as shown in FIG. 34 is quite advantageous for the illustrated disposition of the feed roll and feed plate.

Figure 33:
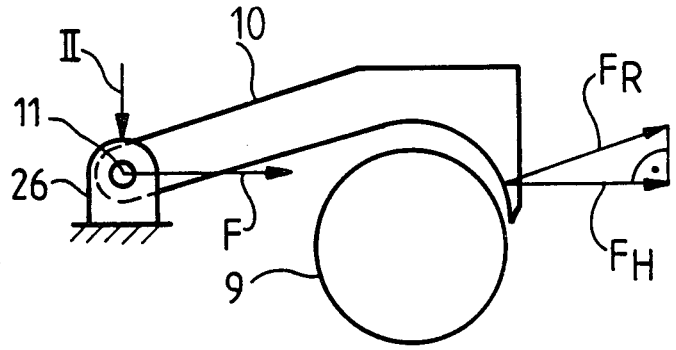
FIG. 33 schematically illustrates part of the arrangement of FIG. 4 but depicting further details thereof.

At this point reference will be made to FIG. 33 which further illustrates that the force F which acts upon the related pivot shaft or axis 11 (or pivot journal) corresponds to a force $F_H$ which need not be, however, located in the same plane as the force F. This force $F_H$, in turn, constitutes a component of the resultant force $F_R$ resulting from the aforenoted compression or pressure and frictional forces exerted by the fiber or fibrous material upon the feed plate 10.

Figure 34:
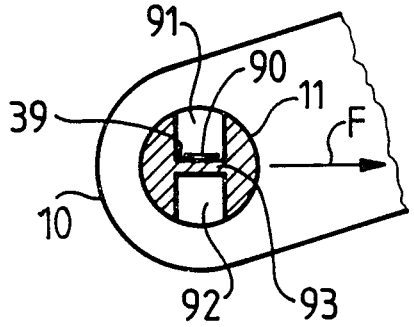
FIG. 34 illustrates part of the arrangement of FIG. 4 on an enlarged scale and in sectional view, taken substantially along the line I—I of FIG. 35.
Figure 35:
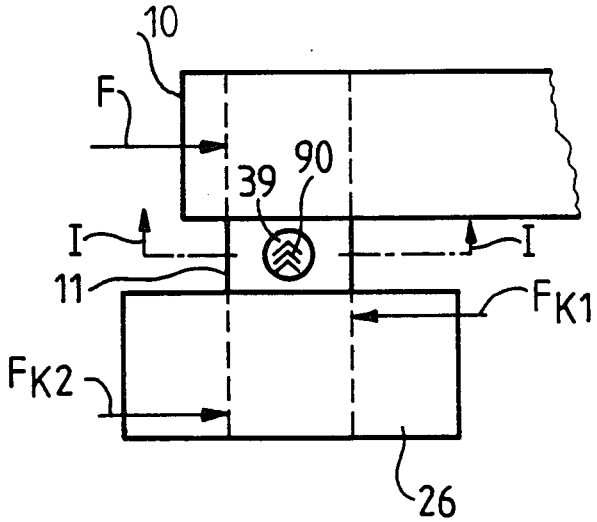
FIG. 35 illustrates part of the arrangement of FIG. 4, again on an enlarged scale, and looking in the direction of the arrow II of FIG. 33.

By way of example, there has been depicted in a somewhat enlarged scale in FIGS. 34 and 35 and thus in greater detail than in the illustration of, for instance, FIG. 5, that the surfaces 39 which are provided with the strain gauges 90 can each constitute, for instance, a planar base surface of a related first bore 91 and by means of a further or second bore 92, arranged in mirror image relationship to the aforementioned first bore 91, there can be formed a web 93 constituting the weakest location of the associated shaft or journal defining the pivot shaft or axis 11 of the related feed plate 10. The strain gauges 90 mounted in the aforementioned manner are commercially available and, for instance, obtainable from the Swiss firm REGLUS Corporation, located at Adliswil, Switzerland.

Furthermore, in FIG. 35 there have been illustrated the compensation or reaction force $F_{K1}$ and $F_{K2}$ which prevail by virtue of the force F. The forces F and $F_{Kl}$ act in such a manner that the strain gauges 90 are deformed essentially in accordance with the shear or transverse forces appearing at the related web 93. The force $F_{K2}$ is applied to prevent the occurrence of an undesired turning moment on the feed plate 10. The forces which have been illustrated in FIG. 35 have been portrayed simply for explanatory purposes and are not drawn to scale or in the precise direction in which they act.

It will be recognized that the thickness or density variations of the infed fiber or fibrous material, such as those of the batt or lap 15 of the exemplary arrangement of, for instance, FIGS. 1, 2 and 4 or for that matter that of the fibrous material infed into the fiber infeed means or device 2.1 of FIG. 3 heretofore described, are detected by employing a force measuring technique. This is possible because, during operation, the one coacting fiber feed element, such as the feed plate 10 or 29, is held stationary with reference to the other coacting fiber feed element, namely the feed roll 9 so as to form a stationary nipping zone or region 23 or 23.1, in other words, a nipping zone or region which does not vary in size. The fibers act upon the stationary feed plate 10 or 29 associated with the force measuring elements, here the strain gauges 90, so that depending upon the variation in thickness of the fiber material 15 infed through the stationary nipping zone or region 23 or 23.1, such thickness variations of the infed fiber or fibrous material 15 can be reliably and exceedingly accurately detected and there can be generated the signals, such as the signal 16 shown in FIGS. 1 and 4 representative of the thickness variations of the fibrous material 15. This force measuring technique is utilized throughout a great many of the other embodiments herein described. At this point it is specifically mentioned that the use of such force measuring technique is employed in the embodiment of FIGS. 6 and 7 now to be described.

Figure 6:
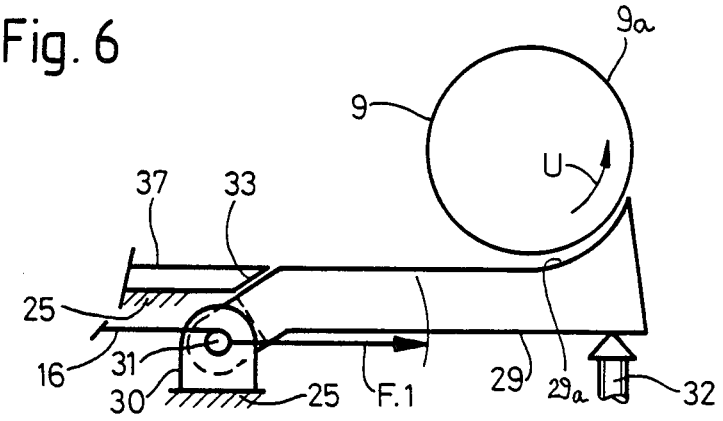
FIG. 6 illustrates, analogous to the showing of FIG. 4, a longitudinal view of a further embodiment of the fiber infeed means.
Figure 7:
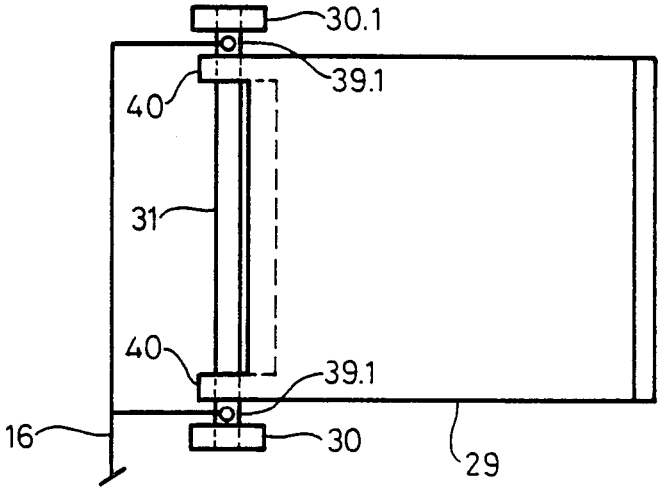
FIG. 7 illustrates a top plan view of the modified construction of fiber infeed means depicted in FIG. 6.

Thus, attention now is directed to this modified embodiment of the fiber infeed means or devices as depicted in such FIGS. 6 and 7. FIG. 7 shows in top plan view the arrangement of FIG. 6, and specifically portrays the feed plate 29, the pivot shaft or axis 31 and the bearing housing 30 as well as a second bearing housing 30.1 which likewise receives the pivot shaft 31. Likewise, the feed plate 29 will be seen to comprise two bearing brackets or collars 40 which receive the pivot shaft 31. In analogous fashion as has heretofore been described with reference to FIGS. 4 and 5, and also FIGS. 33 to 35, the pivot shaft 31 contains at the intermediate spaces between the bearing brackets 40 and the bearing housing 30 and 30.1, respectively, a respective surface 39 for the reception of an associated strain gauge, like the strain gauges 90 depicted in FIGS. 34 and 35 but not here specifically shown to simplify the illustration.

Just as was heretofore the case, also with the embodiment of FIGS. 6 and 7 the strain gauges are arranged in such a manner that each of these strain gauges generates a respective signal corresponding to the magnitude of the force F.1 (FIG. 6) which during operation of the system acts upon the feed plate 29 of the fiber infeed means or device, and again both of these generated signals are converted, for instance, in an average or mean value former to produce the signals 16 which are representative of thickness fluctuations of the infed fibrous material. It is also here mentioned that the force F.1 is generated in analogous fashion to the force F described with reference to the embodiments of FIGS. 4 and 5. Here also the optimum direction of the force F.1 is determined empirically as previously explained, and it is likewise usually sufficiently accurate to have such force direction simply approach the optimum direction.

In the embodiments depicted in FIGS. 8 and 9, 12 and 13, 16 and 17, 20 and 21 as well as 24 and 25, with the exception of the measuring or sensing means for deriving or generating each signal 16, there have been generally illustrated the same elements or components as illustrated with reference to the embodiment of FIGS. 4 and 5. Hence once again the same reference characters have been used for designating the same or analogous components as a matter of convenience. The same also holds true for the embodiments of FIGS. 10 and 11, 14 and 15, 18 and 19 as well as 22 and 23 with respect to the analogous elements or components depicted in the embodiment of FIG. 3 and that of FIGS. 6 and 7.

Figure 8:
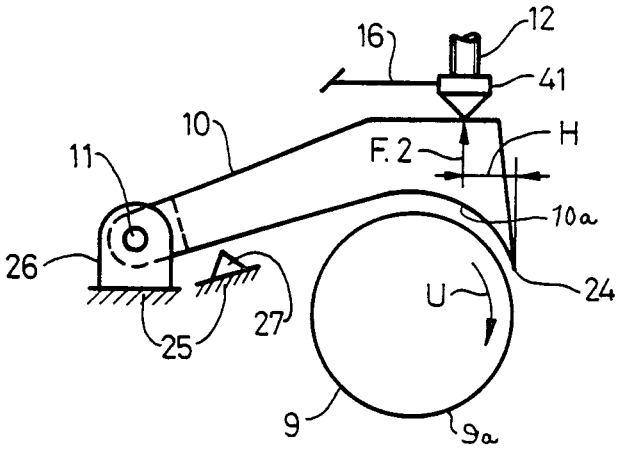
FIG. 8 illustrates, analogous to the showing of FIG. 4, a longitudinal view of a further embodiment of the fiber infeed means.
Figure 9:
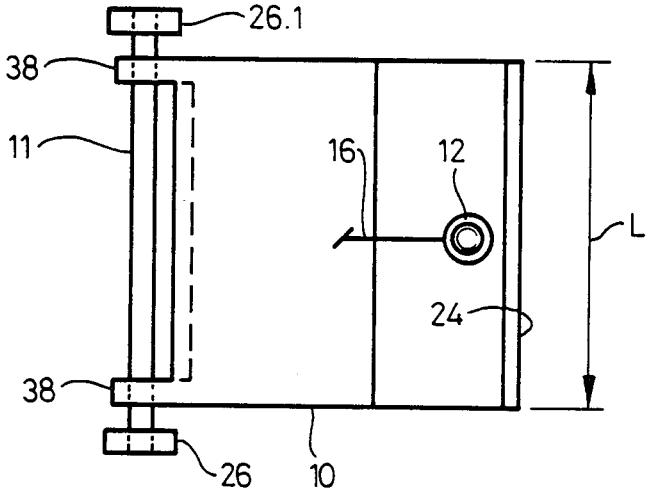
FIG. 9 illustrates a top plan view of the modified construction of fiber infeed means depicted in FIG. 8.

The measuring means or measuring or sensing expedients depicted in the variant embodiment of FIGS. 8 and 9 constitute a force measuring cell 41 or equivalent structure which is operatively associated with or constitutes a component of the stop or abutment 12, again depicted as the adjusting or adjustment screw or equivalent structure, such that this force measuring cell 41 delivers or generates a signal 16 which corresponds to the magnitude of the force F.2 (FIG. 8) applied by the fibers against the stationary feed plate 10 which abuts the adjusting or adjustment screw 12. This force F.2 constitutes a resultant force of the forces generated, during operation of the system, by the fiber material, like the fiber batt or lap 15 shown in FIG. 1 but not particularly depicted in FIG. 8, which is present in the region of the aforementioned essentially invariable or unchanging size nipping zone or region 23. This resultant force F.2 acts in the direction of the lengthwise axis of the adjusting or adjustment screw 12. This adjusting or adjustment screw 12 is, for instance, here arranged at the central region of the machine cross-width or length L of the feed plate 10, as will be recognized by inspecting FIG. 9. Furthermore, by again reverting to FIG. 8 it will be seen that the essentially horizontal distance H of the aforementioned lengthwise axis of the adjusting or adjustment screw 12 to the fiber transfer nose or nose member or end portion 24 of the feed plate 10 is not particularly critical, although it is desirable to strive for or attain as small as possible spacing H.

Figure 10:
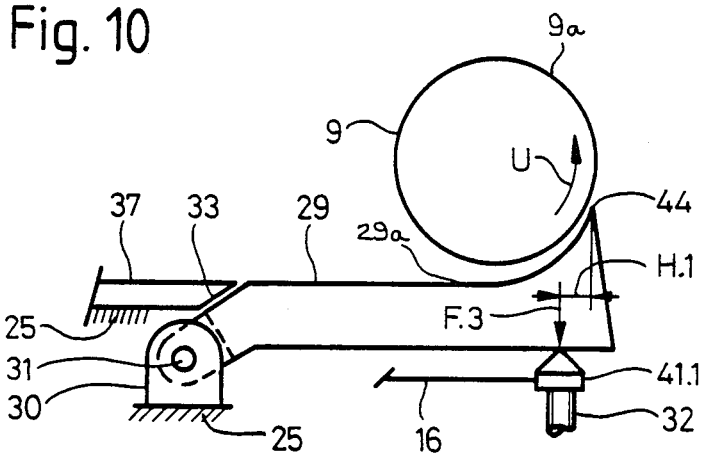
FIG. 10 illustrates, analogous to the showing of FIG. 4, a longitudinal view of a further embodiment of the fiber infeed means.
Figure 11:
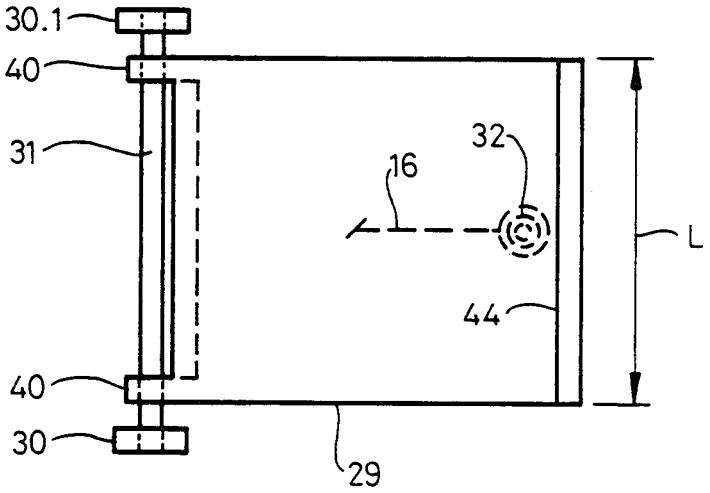
FIG. 11 illustrates a top plan view of the modified construction of fiber infeed means depicted in FIG. 10.

The same observations hold true for the force measuring cell 41.1 which is operatively associated with or a part of the adjusting or adjustment screw 32 of the modified arrangement of FIGS. 10 and 11. Here also a force F.3, analogous to the force F.2 of the embodiment of FIGS. 8 and 9, acts upon the force measuring cell 41.1. Analogous to the prior described embodiment of FIGS. 8 and 9, in the screw 32 acts, for instance, at the center of the machine cross-width or length L of the feed plate 29, and is arranged, as viewed in FIG. 10, at a horizontal spacing or distance H.1 from the fiber deflection nose or edge or end portion 44 of this feed plate 29 and with respect to the force F.3 which acts in the direction of the lengthwise axis of the adjusting or adjustment screw 32.

Figure 12:
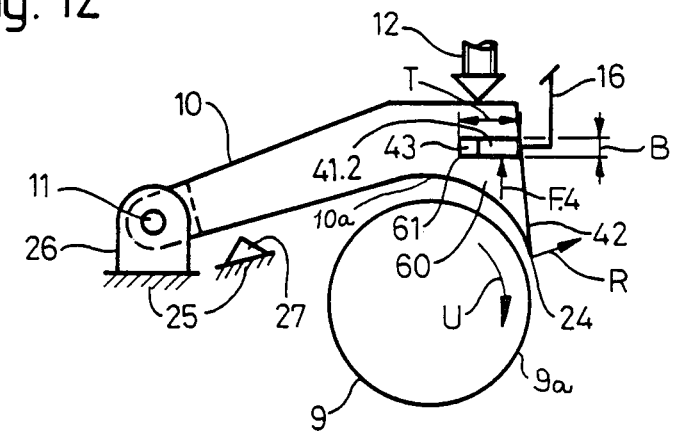
FIG. 12 illustrates, analogous to the showing of FIG. 4, a longitudinal view of a further embodiment of the fiber infeed means.
Figure 13:
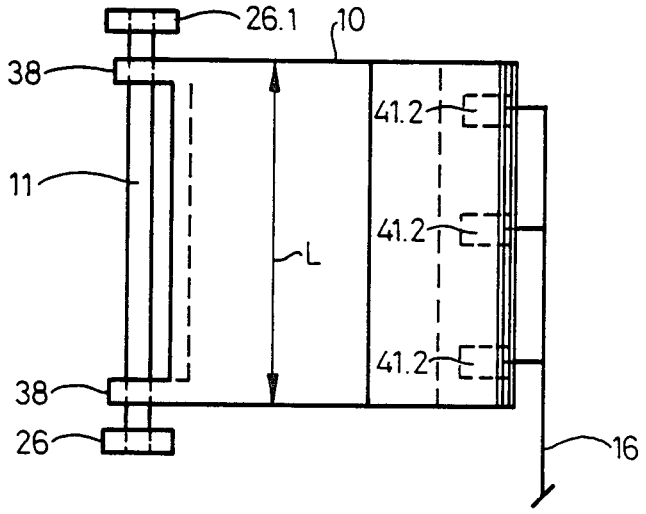
FIG. 13 illustrates a top plan view of the modified construction of fiber infeed means depicted in FIG. 12.
Figure 14:
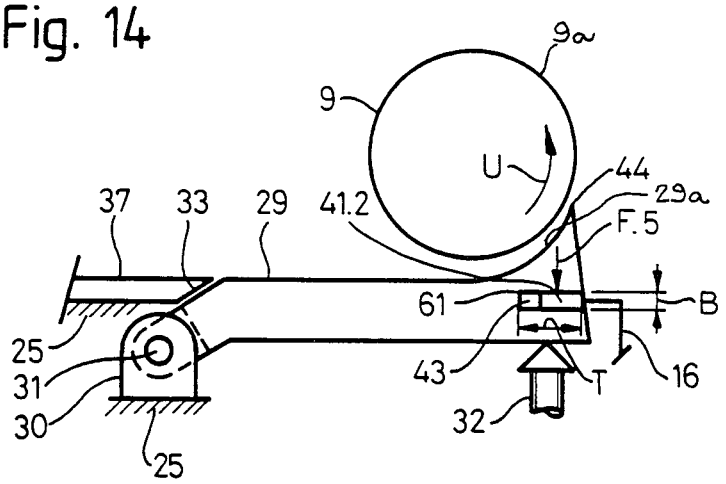
FIG. 14 illustrates, analogous to the showing of FIG. 4, a longitudinal view of a further embodiment of the fiber infeed means.

FIGS. 12 and 13 as well as 14 and 15, respectively, each depict a variant embodiment as concerns the use of the force measuring cells for determining the forces generated during operation of the fiber infeed system owing to the density or thickness variations of the fiber material at the region of the wedge-like nipping zone or region, like the nipping zones or regions 23 and 23.1, respectively, depicted in FIGS. 2 and 3 (although not particularly referenced in each of FIGS. 12 and 14).

The feed plate 10 of the embodiment of FIGS. 12 and 13 possesses at the end face or surface 42 which confronts the licker-in cylinder or roll 3 (FIG. 2) a continuous groove or slot 43. This continuous groove or slot 43 extends over the entire machine cross-width or length L (FIG. 13) of the feed plate 10 and has a depth T and a height B (FIG. 12). The groove or slot height B is selected such that the force measuring cells 41.2 can be inserted essentially free of play into the groove or slot 43 and can be fixedly retained therein in the position depicted in FIGS. 12 and 13.

During operation, the fiber material, such as the batt or lap 15 shown in FIG. 1 but not particularly depicted in FIG. 12 and located in the region of the nipping zone or region, like the essentially invariable size nipping zone or region 23 of FIG. 2 but not here specifically referenced, between the feed plate 10 and the feed roll 9 exert forces which have the tendency to deform or flex a part or portion 60 of the feed plate 9 in the direction R about an inner groove edge 61. This part or portion 60 of the feed plate 9 is located between the continuous or through-going groove or slot 43 and the fiber release or delivery edge or nose or nose member 24 of the feed plate 10. From these forces there results a force F.4 which is effective over the entire machine cross-width or length L of the feed plate 10 and which generates an appropriate signal in each of the force measuring cells 41.2. The signals of the individual force measuring cells 41.2 are advantageously averaged or meaned in a suitable average or mean value forming circuit so as to produce each of the aforedescribed signals 16. By appropriately selecting the number and arrangement of the force measuring cells 41.2 they each can receive a proportional or predeterminate part of the applied forces emanating from the throughpassing mass of fiber material.

Figure 15:
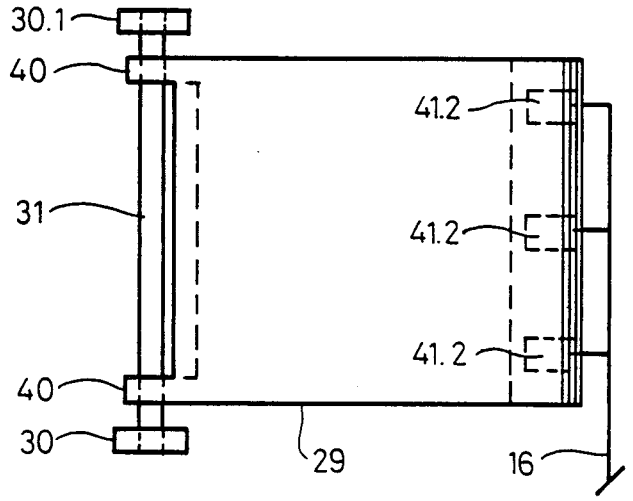
FIG. 15 illustrates a top plan view of the modified construction of fiber infeed means depicted in FIG. 14.

The variant embodiment depicted in FIGS. 14 and 15 functions, as far as the generation of each of the signals 16, essentially like the embodiment described with reference to FIGS. 12 and 13. Therefore, the elements required for generating each signal 16 have been conveniently designated in FIGS. 14 and 15 with the same reference characters as were employed for the embodiment of FIGS. 12 and 13, with the exception of the force F.5 which, by virtue of the different manner of fiber transfer at the nose or nose member 44 of the feed plate 29 to the licker-in cylinder 3, possesses a different magnitude than the force F.4 of the arrangement of FIG. 12 in which the fibers are transferred in so-to-speak the same direction or unidirectionally from the feed roll 9 to the licker-in cylinder 3. This unidirectional fiber transfer arises by virtue of the fact that the feed roll 9 and the licker-in cylinder 3 exhibit the same direction of movement or rotation (here counterclockwise) at the fiber transfer location (see FIG. 1). However, other factors can play a role in the generation or formation of the force component F.5, such as for example the form of the feed plate 10 or 29, as the case may be, at the region of the nipping zone or region, which, as previously stated would be designated by reference characters 23 or 23.1, respectively, like indicated in FIGS. 2 and 3, as well as the spacing of the groove edge 61 from the surface 10*a* or 29*a* of the feed plate 10 or 29, respectively, guiding the fiber material 15. It is to be specifically understood that the invention is not limited in any way to the number and arrangement of the force measuring cells depicted in FIGS. 13 and 15. It should be understood that, for instance, depending upon the strength of the part of the feed plate 10 or 29 extending from the continuous groove 43 up to the fiber release edge or nose 24 (FIG. 12) or to the nose or nose member 44 (FIG. 14) there can be provided one, two or a greater number of force measuring cells 41.2.

Figure 16:
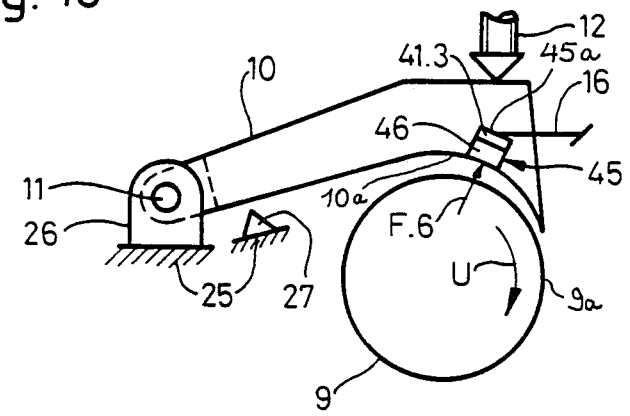
FIG. 16 illustrates, analogous to the showing of FIG. 4, a longitudinal view of a further embodiment of the fiber infeed means.
Figure 17:
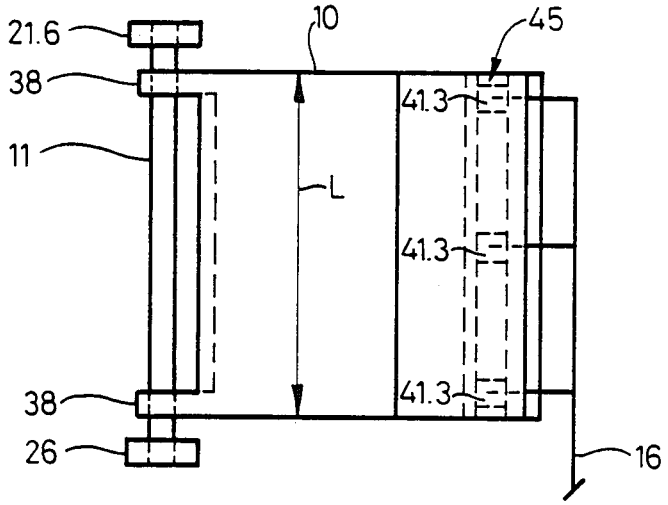
FIG. 17 illustrates a top plan view of the modified construction of fiber infeed means depicted in FIG. 16.

In the embodiment of FIGS. 16 and 17 the measuring means or expedients comprise three force measuring cells 41.3. These force measuring cells 41.3 are arranged in a groove or slot 45 formed in the feed plate 10 and opening at the region or bounding surface of the nipping zone or region, like the nipping zone or region designated by reference numeral 23 in FIGS. 1 and 2 into such nipping zone or region. The force measuring cells 41.3 here bear against the base or floor 45*a* of the groove or slot 45.

In order to transmit the force components F.6 to the force measuring cells 41.3, and which force components F.6 act over the entire machine cross-width or length L of the feed plate 10 and are generated by the fiber material located in the nipping zone or region, the force measuring cells 41.3 are here covered by a force transmitting beam or beam member 46 or equivalent force transmission structure. This force transmitting beam or beam member 46 is completely adapted to fully close the associated groove or slot 45 and without causing disturbing bending to the form of the feed plate 10. The signals which are delivered by the individual force measuring cells or units 41.3 are again converted in a conventional average or mean value former to produce the respective signals 16 as heretofore described. The distribution of the aforementioned force measuring cells or units 41.3 in the groove or slot 45 is essentially accomplished in the manner depicted in FIG. 17. However, it should be understood that the number of force measuring cells or units 41.3 is not limited to the three depicted force measuring cells or units 41.3. For instance, when using a force transmitting beam or beam member which is designed to possess an appropriate strength there can be used only two force measuring cells or units 41.3, whereas if a finer or more precise detection of the force components over the length L of the feed plate 10 (FIG. 17) is to be detected, there can be distributively arranged a larger number of force measuring cells or units 41.3.

Figure 18:
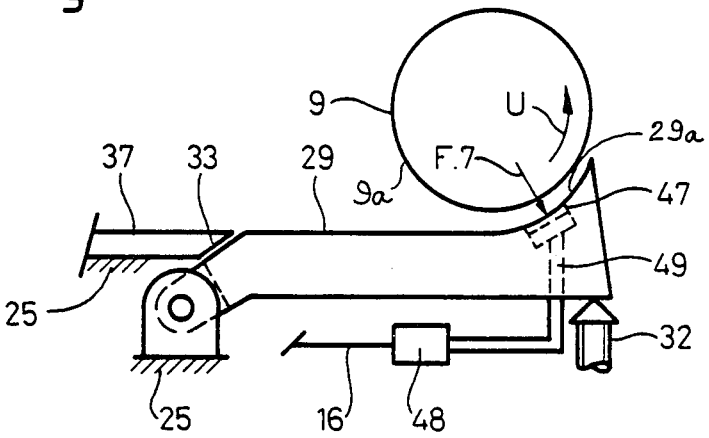
FIG. 18 illustrates, analogous to the showing of FIG. 4, a longitudinal view of a further embodiment of the fiber infeed means.
Figure 19:
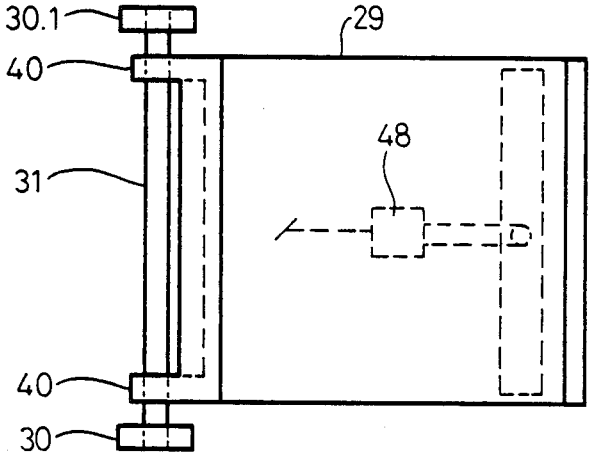
FIG. 19 illustrates a top plan view of the modified construction of fiber infeed means depicted in FIG. 18.

The measuring means of the embodiment of FIGS. 18 and 19 comprises a membrane or diaphragm 47 or equivalent structure which is incorporated into or installed at the feed plate 29, a pressure converter or transducer 48 and a pressure fluid system 49 which interconnects the membrane or diaphragm 47 with the pressure converter 48.

A force component F.7 (FIG. 19) analogous to the force F.6 of the embodiment depicted in FIGS. 16 and 17, causes a pressure to be exerted upon the membrane or diaphragm 47. As a result, there is transmitted a force by means of the pressure fluid system 49 to the pressure converter 48 and which generates a signal 16 corresponding to the force F.7.

Figure 20:
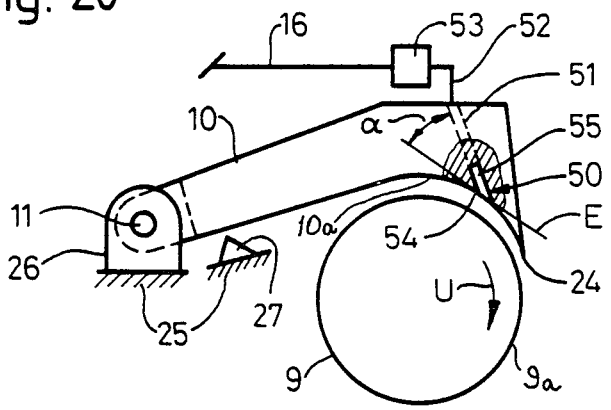
FIG. 20 illustrates, analogous to the showing of FIG. 4, a longitudinal view of a further embodiment of the fiber infeed means.
Figure 21:
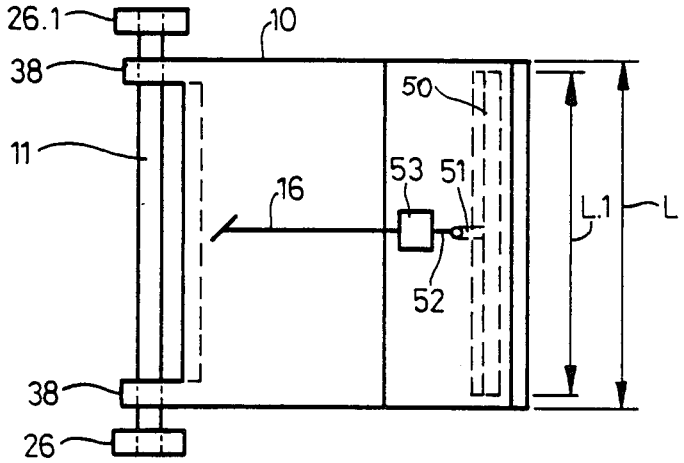
FIG. 21 illustrates a top plan view of the modified construction of fiber infeed means depicted in FIG. 20.

The measuring means of the embodiment of FIGS. 20 and 21 is predicated upon the recognition that upon introducing the fiber material into the wedge-shaped converging nipping zone or region between the feed plate 10 and the feed roll 9, that is to say, in the region of the essentially invariable or unchanging size wedge-shaped converging nipping zone or region, like the wedge-shaped converging nipping zone or region 23 shown in FIG. 2, air will be expelled or expressed out of the fiber material 15, such as the batt or lap 15, owing to the increasing constriction or narrowing of the wedge-shaped nipping zone or region 23.

Expulsion or displacement of this air is counteracted by the resistance of the batt or lap 15, so that in the batt or lap 15 there arises an increasing excess pressure in the direction of the fiber transfer edge or region or nose 24. The resistance to air flow is representative of the momentary or instantaneous thickness of the fiber material, here the batt or lap 15, and the amount of air which is to be expelled.

This excess pressure is detected by the measuring means depicted in the embodiment of FIGS. 20 and 21, in that a measuring groove or slot or channel 50 is appropriately formed in the feed plate 10. This measuring groove or slot 50 is connected within the confines of the feed plate 10 by means of a pressure line or conduit 51 and a pressure line or conduit 52 connected with the feed plate 10 to a pressure converter or transducer 53. This pressure converter or transducer 53 converts the excess pressure determined at the measuring groove or slot 50 into the signal 16.

As will be apparent from the illustration of FIG. 21 the measuring groove or slot 50 is not continuous over the entire machine cross-width or length L of the feed plate 10, that is to say, the length L.1 of the measuring groove or slot 50 is shorter than the length L of the feed plate 10. Thus, as far as the measuring groove or slot 50 is concerned, such constitutes a measuring groove or slot located in the region of the nipping zone or region 23 and which is only open towards such nipping zone or region.

As depicted in FIG. 20, the measuring groove or slot 50 forms an acute angle with an imaginary plane E. This imaginary plane E, as a tangential plane, contains the mouth edge 54 of the wall 55 of the measuring groove or slot 50 and which wall 55 is located on the side of the pivot shaft 11. By virtue of this arrangement there is avoided that a build up of fibers will occur within the measuring groove or slot 50. The angle $\alpha$ amounts at most to 30°.

Figure 22:
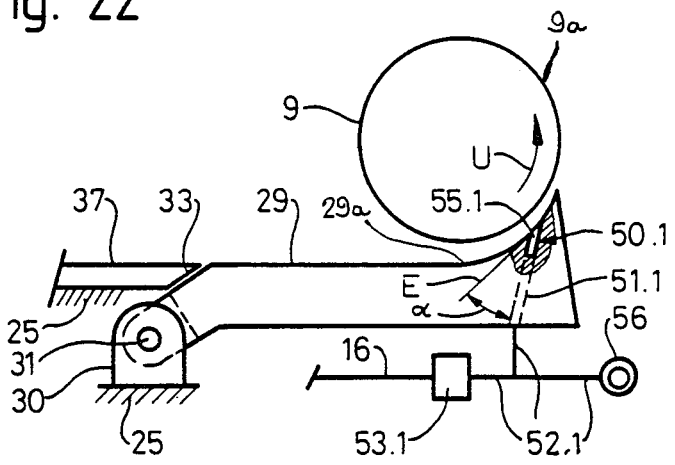
FIG. 22 illustrates, analogous to the showing of FIG. 4, a longitudinal view of a further embodiment of the fiber infeed means.
Figure 23:
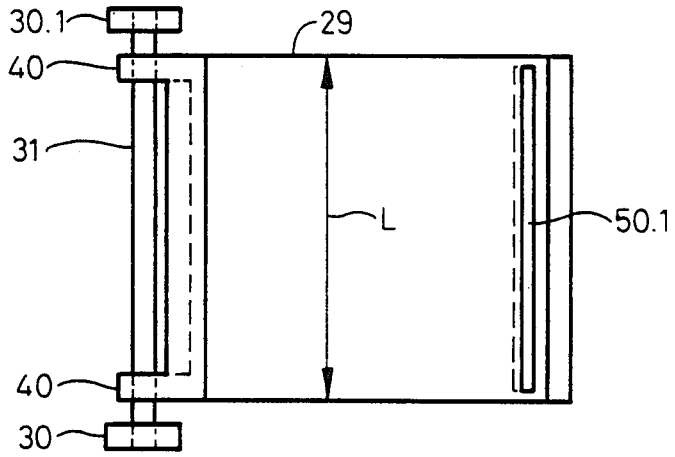
FIG. 23 illustrates a top plan view of the modified construction of fiber infeed means depicted in FIG. 22.

FIGS. 22 and 23 show an embodiment wherein there is provided a measuring groove or slot 50.1 analogous to the measuring groove or slot 50 of the prior discussed embodiment of FIGS. 20 and 21. This measuring groove or slot 50.1 is provided with a therewith operatively connected pressure line or conduit 51.1 as well as a pressure line or conduit 52.1.

In contrast to the measuring means or arrangement of FIGS. 20 and 21, with the measuring means or arrangement of the modified embodiment of FIGS. 22 and 23 there is not only measured the pressure which, as described, results from the expulsion or displacement of the air out of the mass of fiber material, typically the batt or lap 15, rather there is additionally forced into the fiber material which is undergoing compression or compaction a constant quantity of compressed air delivered by a suitable compressed or pressure air source 56 by means of the measuring groove or slot 50.1. The throughpassage of this predeterminate amount of compressed or pressurized air through the fiber material, the batt or lap is, occurs against the resistance of such fiber material, so that a pressure, corresponding to the resistance against the throughflow of air through the fiber material, can be transmitted from the pressure lines or conduits 51.1 and 51.2 to a pressure converter or transducer 53.1 connected with the pressure line or conduit 51.2.

Since the resistance to the flow of air varies with the density or thickness of the fiber material, in other words, that of the batt or lap 15 in the region of the essentially invariable or unchanging size nipping zone or region, like the nipping zone or region 23.1 of FIG. 3 but not here specifically referenced, there also is altered the pressure in the lines or conduits 51.1 and 52.1. The pressure converter or transducer 53.1 converts such pressure variations or fluctuations into the signal 16.

As will be also evident from the illustration of FIG. 22, here also the measuring groove or slot 50.1 exhibits the angle $\alpha$ described previously with reference to the embodiment of FIGS. 20 and 21.

Figure 24:
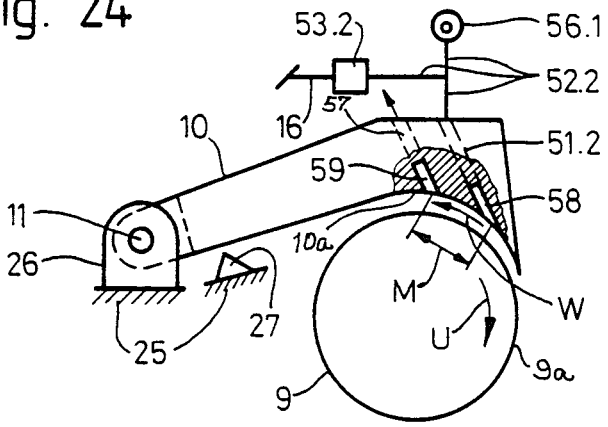
FIG. 24 illustrates, analogous to the showing of FIG. 4, a longitudinal view of a further embodiment of the fiber infeed means.
Figure 25:
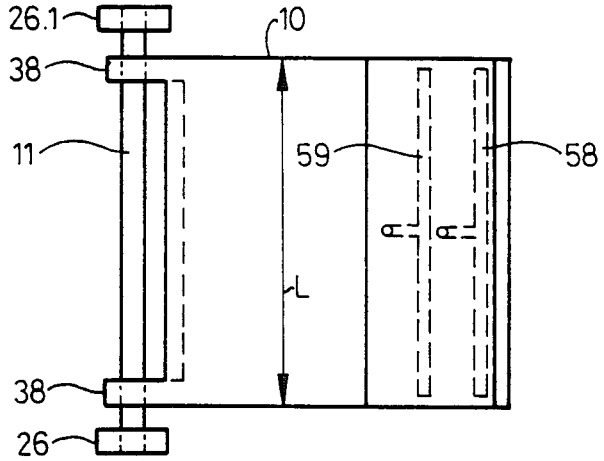
FIG. 25 illustrates a top plan view of the modified construction of fiber infeed means depicted in FIG. 24.

FIGS. 24 and 25 show a variant embodiment of the measuring means or measuring expedient from that depicted in FIGS. 22 and 23. Here, the constant quantity of compressed or pressurized air delivered by the compressed or pressurized air source 56.1 is blown by means of a blow or blow-in groove or slot 58 into the fiber material located in the region of the essentially invariable or unchanging size nipping zone or region, like the nipping zone or region 23 of the embodiment of FIG. 2 but not here specifically referenced. This blown-in air migrates in such fiber material in a direction W which is opposite to the rotational direction U of the feed roll 9 until it can escape into the atmosphere by means of a venting groove or slot 59 and a venting line or conduit 57 connected therewith.

A pressure converter or transducer 53.2 is connected with the line or conduit 52.2. This pressure converter or transducer 52.2 converts the pressure prevailing in the pressure line or conduit 52.2 into the signal 16. There can be defined or determined a resistance region between the blow-in or blow groove or slot 58 and the venting groove or slot 59 by appropriate selection of the distance M between these components 58 and 59, as indicated in FIG. 24.

Figure 26:
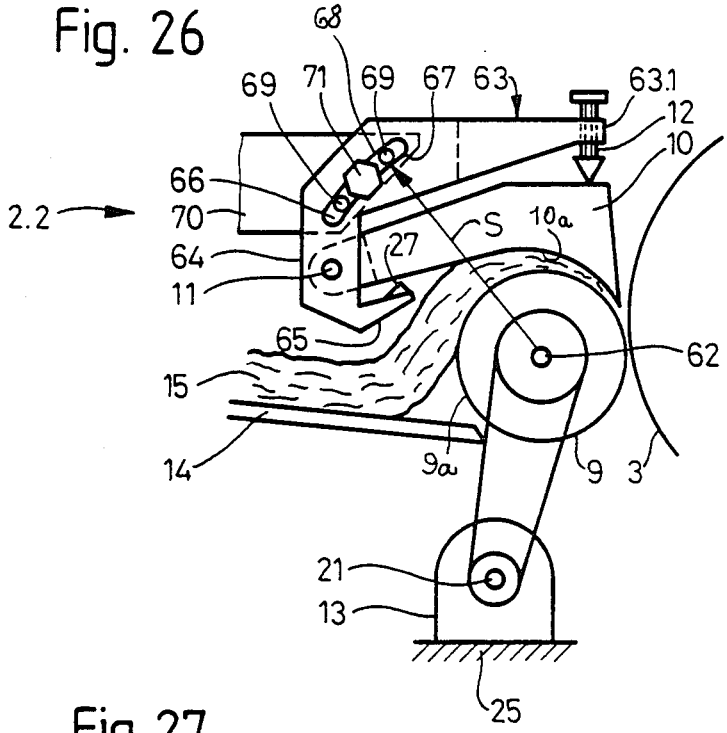
FIG. 26 illustrates, analogous to the showing of FIG. 4, a longitudinal view of a further embodiment of the fiber infeed means.
Figure 27:
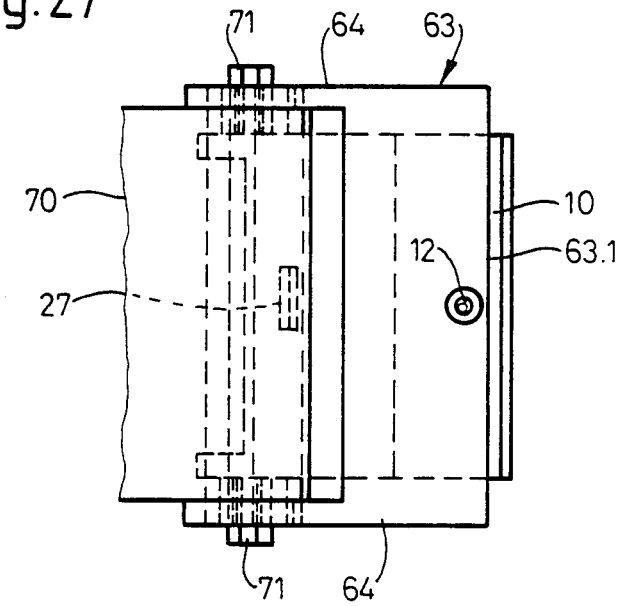
FIG. 27 illustrates a top plan view of the modified construction of fiber infeed means depicted in FIG. 26.

FIGS. 26 and 27 illustrate a variant embodiment of the fiber infeed means or device 2.2 from that depicted in FIG. 2. In the arrangement of FIGS. 26 and 27 the fiber feed plate 10 is not only pivotable about the pivot shaft or axis 11, but such is additionally pivotable or displaceable about a further pivot shaft or axis 62 which is coaxially disposed with respect to the rotational axis of the feed roll 9. This pivotability has been schematically represented by the radius arrow line or radius S shown in FIG. 26.

To render this pivotal motion possible, there is provided a holder bracket or holder 63 or equivalent structure, which possesses two legs or leg members 64 (only one of which is visible in the showing of FIG. 26) and in which leg members there is mounted the pivot shaft or pivot means 11.

These legs or leg members 64 are connected with a continuous web or strut member 65 extending beneath the feed plate 10 (as viewed with reference to FIG. 26). This web or strut member 65 serves for accommodating the previously discussed stop or abutment 27.

Additionally, the legs or leg members 64 each have a guide slot or recess 66, the lower guide surface 67 of which, as viewed with reference to FIG. 26, possesses a curvature having the aforementioned radius S. The upper guide surface 68 which is disposed opposite to the lower guide surface 67 is arranged substantially parallel to the lower guide surface 67.

These guide slots 66 each serve for the reception of two guide bolts or bolt members 69 which are fixedly of these two guide bolts or bolt members 69 is selected in relation to the length of the associated guide slot 66 such that the holder bracket or holder 63 is pivotable through a predeterminate pivot length about the pivot shaft or axis 62.

In order to fixedly retain the holder bracket or holder 63 in a selected pivotal position, this holder bracket 63 is fixedly held by means of two screws or threaded bolts 71 or equivalent structure threaded into the machine housing part 70 and extending through the associated guide slot 66.

Additionally, the adjusting or adjustment screw 12 is arranged at an end portion 63.1 of the holder bracket or holder 63 and which is directed or extends towards the licker-in cylinder or roll 3.

It should be clearly understood that also with this embodiment there can be used and combined all of the elements needed for generating the signals 16 as have been described with reference to the various embodiments depicted in FIGS. 4 to 25 inclusive. Therefore it is unnecessary to repeat the use of these elements in conjunction with this variant embodiment of the invention.

Figure 28:
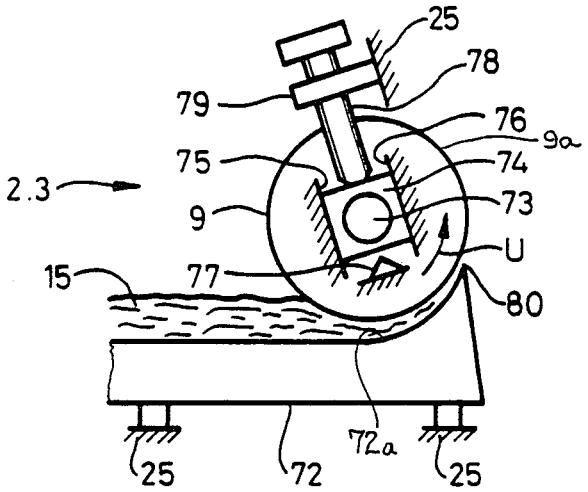
FIG. 28 illustrates, analogous to the showing of FIG. 4, a longitudinal view of a further embodiment of the fiber infeed means.
Figure 29:
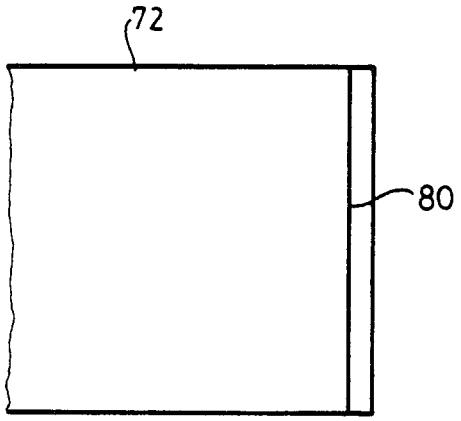
FIG. 29 illustrates a top plan view of the modified construction of fiber infeed means depicted in FIG. 28.

FIGS. 28 and 29 show a further embodiment of the fiber infeed means or device 2.3 from that shown in FIG. 3. In the embodiment of FIGS. 28 and 29 there is provided a feed plate 72 having a nipping surface **72*a* and which is fixedly connected with the machine housing 25, whereas the feed roll 9** is movable throughout a given region or range.

The mobility of the feed roll 9 is attained by virtue of the fact that the free ends 73 of the here not particularly referenced rotational shaft or axis of the feed roll 9 and which protrude at both sides from the feed roll 9 (in FIG. 28 there is shown only one such side) are received in a respective associated bearing bushing or block 74 or equivalent structure. Each such bearing bushing 74 is displaceably guided between two stationary slide guides or guide members 75 and 76, respectively. The displacement range of the feed roll 9 is limited, on the one hand, by a stationary stop or abutment member 77 as well as by an adjustable or adjustment screw 78 or equivalent structure. The adjustment screw 78 is received in a support or carrier 79 which, in turn, is secured to the machine housing 25. The stop or abutment 77 has the same function as the previously described stop or abutment 27.

During operation, the mass of fiber material, for instance, the batt or lap 15, is slidingly moved upon the feed plate 72 by the action of the feed roll 9 into the substantially wedge-shaped converging nipping zone or region 23 between the feed roll 9 and the feed plate 72. Consequently, the feed roll 9 is lifted out of its starting or initial position, in which the bearing bushings 74 each bear upon an associated stop or abutment 77, until attaining the operating position. In such operating position the bearing bushings 74 each bear against an associated adjusting or adjustment screw 78 constituting a related stop or abutment and form the essentially invariable or unchanging size nipping zone or region, like the nipping zone or region 23.1 of FIG. 3 but here again not particularly referenced.

It should be understood that with the variant embodiment described with reference to FIGS. 28 and 29 there again can be used the elements or components discussed previously with respect to FIGS. 8 to 25 inclusive for generating the signal 16, so that no further explanations are believed to be here warranted.

Figure 30:
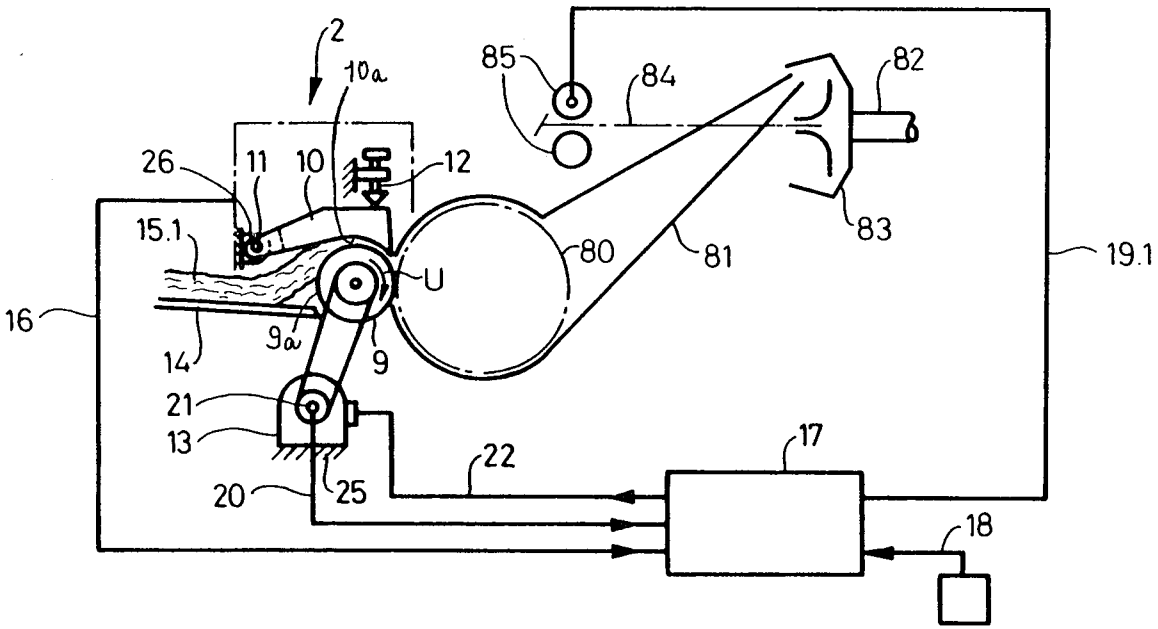
FIG. 30 schematically illustrates an open-end rotor spinning machine equipped with fiber infeed means constructed according to the present invention.

FIG. 30 illustrates a possible field of application of the fiber infeed means 2 as depicted for instance in FIG. 1 in the environment of an open-end rotor spinning machine. Since the mode of operation of such open-end rotor spinning machines are well known and inasmuch as the operational details are not as such crucial for understanding the underlying principles and teachings of the present development, only the more essential components of such open-end rotor spinning machine have been schematically illustrated in the showing of FIG. 30 in order to correlate the coaction of the inventive fiber infeed means or device 2 with such conventional open-end rotor spinning machine. Therefore, the previously described components or elements of the prior explained embodiments have generally been here conveniently designated by the same reference characters to denote the same or analogous components.

During operation of the open-end rotor spinning machine depicted in FIG. 30 the feed roll 9 delivers a mass of fiber material, such as a sliver or band 15.1 or the like, to an opening roll 80. The opening roll 80 transfers the singled or individualized fibers of the thus processed mass of fiber material 15.1 to a conventional rotor 83 which rotates about an axis of rotation or rotational shaft 82 as is well known in this textile technology. Also as is conventional with such type of equipment there is formed a yarn 84 in the spinning rotor 83 which then is withdrawn by a pair of yarn withdrawal rollers 85 or equivalent structure.

The drafting ratio of the spinning machine depicted in FIG. 30 is governed by the relationship between the circumferential velocity of the feed roll 9, dictated by the rotational speed of the shaft 21 driven by the drive motor, again constituted for instance by the gearing or transmission motor 13, and by the circumferential velocity of the pair of withdrawal rollers 85, the rotational speed of which generates the rotational speed-control signal 19.1.

Moreover, even though as a matter of convenience there have been generally used the same reference characters to denote the same or analogous components in this embodiment as were previously employed with the prior explained constructions, it is to be understood that in practice the dimensions of these elements or components can be of different size since an open-end rotor spinning machine constitutes an appreciably smaller textile machine or unit than the carding machine or card schematically depicted in FIG. 1.

Equally, it should be understood that, for instance, the fiber infeed means or device 2.1 depicted in the embodiment of FIG. 3 can also be combined with the open-end rotor spinning unit shown in the arrangement of FIG. 30.

Additionally, it is likewise to be readily self-evident that all of the embodiments heretofore described and depicted in FIGS. 4 to 27, provided for the purpose of generating the signals 16, can be combined and beneficially employed in the open-end rotor spinning machine construction of the arrangement of FIG. 30.

Figure 31:
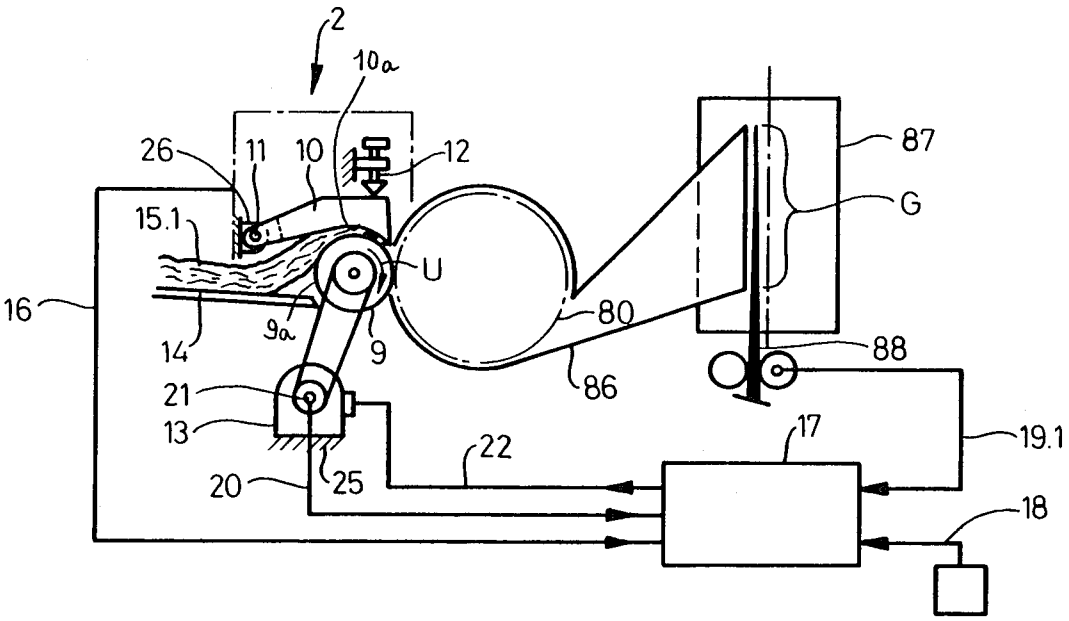
FIG. 31 schematically illustrates an open-end friction spinning machine equipped with fiber infeed means constructed according to the present invention.

Turning attention now to FIG. 31 there is illustrated therein a further field of application of the inventive fiber infeed means or device. In such FIG. 31 the fiber infeed means or device 2, analogous to the arrangement of the fiber infeed device or means 2 of the embodiment of FIG. 30, delivers a mass of fiber or fibrous material, for instance a sliver or band 15.1 or the like, to an opening roll 80. A primary difference between the textile machine of the arrangement of FIG. 31 in contrast to the prior discussed arrangement of FIG. 30 is that in the embodiment of FIG. 31 the textile machine is not an open-end rotor spinning machine, rather a conventional open-end friction spinning machine. Therefore, once again there have been generally conveniently used the same reference characters to denote the same or analogous components.

During operation, the feed roll 9 feeds the mass of fiber material, here typically for instance the sliver or band 15.1, to the opening roll or roller 80 which then transfers the singled or individualized fibers to a subsequently arranged fiber feed channel or duct 86. With the aid of this fiber feed channel or duct 86 the freely floating fibers are transferred to a friction spinning drum 87, upon which there is formed, as is well known in the friction spinning art, within a yarn formation position or location G a spun yarn 88 or the like. This thus formed or spun yarn 88 is then withdrawn by a suitable yarn withdrawal device, here shown as a pair of yarn withdrawal roll or rollers 88.

In the arrangement of FIG. 31 there has been depicted for the purpose of simplifying the illustration only one friction spinning drum 87. However, it is well known in the friction spinning art that, as a general rule when carrying out friction spinning, a coacting or counter-roll is beneficially employed for cooperative interaction with the depicted friction spinning roll or drum 87, this additional friction spinning roll or drum being arranged substantially parallel to the depicted friction spinning roll or drum 87.

Additionally, and analogous to the description of the arrangement of FIG. 30, here also it should be readily apparent that the type of fiber infeed means or device shown for the embodiment of FIG. 3 can be beneficially likewise employed with such type of friction spinning machine or unit, and moreover, all of the embodiments depicted and described in conjunction with FIGS. 4 to 27 likewise can be here employed in order to generate the signals 16.

Turning attention now to the embodiment depicted in FIG. 32, there is illustrated therein a drafting arrangement 100 in which there is employed a variant construction of fiber infeed means or device 2.4 from that depicted and described with reference to FIG. 1. In this variant construction of fiber infeed means or device 2.4 there is employed, instead of the feed plate 10 illustrated in the arrangement of FIG. 1, a counter roll or roller 101. The counter roll 101 with its nipping surface 101*a* together with the feed roll 9 forms the nipping zone or region, here generally indicated by reference numeral 120.

In contrast to the feed roll 9 in this case the counter roll 101 is not a driven roll, that is to say, is a freely rotatable roll and is dragged by the entraining action of the mass of fiber material, for instance the sliver or band 15.1 or the like, which is located between the counter roll 101 and the feed roll 9 arranged in confronting and coacting relationship. This counter roll 101 is mounted to be rotatable and also is pivotably mounted at the pivot lever or lever member 102.

Figure 32:
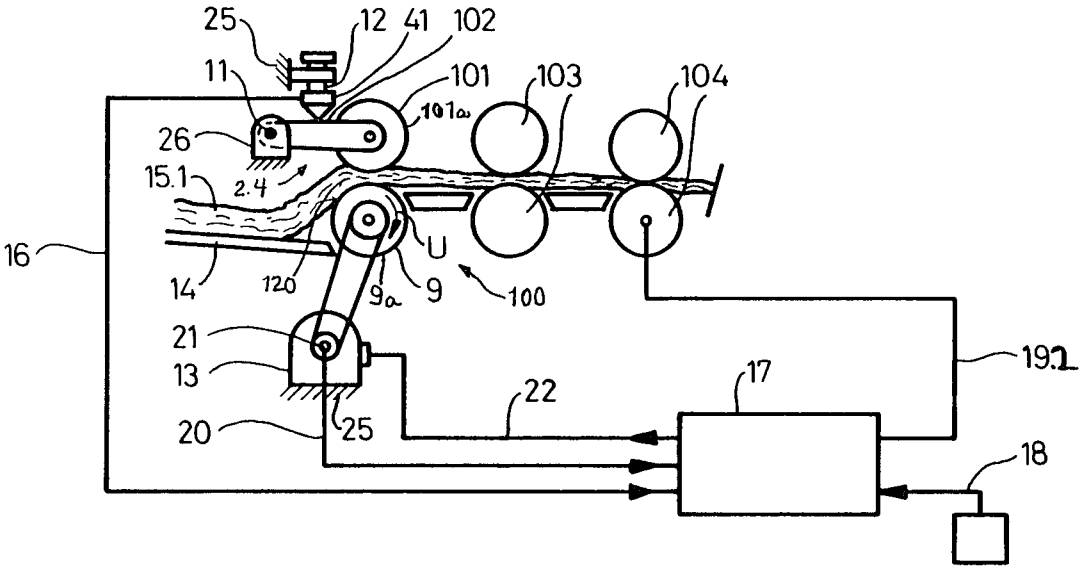
FIG. 32 schematically illustrates a drafting arrangement equipped with fiber infeed means constructed according to the present invention.

The further elements or components shown in the arrangement of FIG. 32 correspond to the elements or components described previously in conjunction with the embodiment of FIG. 1. Hence, as a matter of convenience in jillustration in this variant embodiment of FIG. 32 there have been generally used the same reference characters to denote the' same or analogous components. It will be thus apparent that, for instance, the pivotal lever or lever member 102 is pivotably mounted by means of the pivot shaft 11 and the bearing housing 26.

In order to generate the signals 16 there is used as the measuring expedient or structure the force measuring cell or unit 41 described in conjunction with the embodiment of FIGS. 8 and 9. Hence in this regard reference may again be had to the prior described arrangement of FIGS. 8 and 9.

The roll or roller pair designated by reference characters 103 and 104 are well known types of rollers used in conventional drafting arrangements and thus need not be here further described. At this point it is only mentioned in conjunction with the function of the fiber infeed means or device 2.4 that both of the lower rollers of the roll or roller pair 103 and 104, as viewed in connection with the showing of FIG. 32, are driven at a predetermined or fixed rotational speed which governs the draft in the drafting arrangement 100. The upper rollers of this roller or roller pair 103 and 104 are likewise dragged by the action of the mass of fiber material 15.1 which drags the roll or roller 101.

The drafting relationship of the spinning machine depicted in FIG. 32 is governed by the circumferential velocity of the feed roll 9, dictated by the rotational speed of the shaft 21 of the drive motor, namely the gearing or transmission motor 13, and by the circumferential velocity of the lower roll or roller 104, dictated by the rotational speed thereof which generates the rotational speed signal 19.2. This signal 19.2 has the same function as the signal 19.1 of the respective embodiments of FIGS. 30 and 31 as well as the signal 19 of the arrangement of FIG. 1. Here also elements or components which have the same function as those previously considered have therefore been generally conveniently identified by the same reference characters.

There are numerous advantages which arise by virtue of the teachings of the present invention. One advantage which is obtained by fixing the nipping zone or region, in other words providing a stationary nipping zone or region, i.e., a nipping zone or region which does not change in size during operation of the equipment, in order to measure the thickness or density and thus the thickness and density variations of the intermediately situated mass of fiber material, for instance the batt or lap or sliver or band, in contrast to the heretofore known measuring techniques and equipment of the prior art for accomplishing such measuring techniques and specifically relying upon distinct and visible and measurable alterations or variations in the size of the nipping zone or region resulting from variations in the density or thickness of the throughpassing fiber material, is that with the teachings of the present invention the measuring signals have and appropriately large amplitude owing to the intensive force variations which can be reliably, sensitively and quite accurately detected. A further advantage resides in the fact that when working with the force measuring technique or method and equipment of the present development the undesirable hysteresis effect which arise when using a displacement measuring technique in a changing or varying size nipping zone or region, as proposed in prior art constructions, are eliminated or at least appreciably suppressed, thus providing a more accurate or true measurement result.

A further advantage obtainable with the teachings of the present invention is that when using the inventive force measuring technique there can be ascertained density or thickness variations of the infed mass of fiber material at a discrete location or region of a fiber feed element or equivalent or specific detection element at which the forces to be detected are exerted, such as the feed plate which is held stationary or immobile against the coacting stop or abutment during operation, resulting in a much more sensitive and precise detection of undesirable alterations or variations in the density or thickness of the fiber material. This detection location is advantageously near to but upstream of the fiber transfer nose of the feed plate considered with respect to the travel direction of the mass of fiber material. In other words, the determination of thickness variations of the fiber material, such as the batt or lap, is accomplished near to the narrowest location of the nipping zone or region between, for instance, the feed plate and the feed roll, that is, essentially near to that location at which the fiber material is received by the licker-in roll. Consequently, there is obtained an extremely short path between the measuring location and the fiber transfer location, or, stated in another way, the point in time at which there is accomplished the measurement is quite close to the point in time when there is undertaken the required rotational speed correction of the feed roll.

Finally, it is mentioned that various modifications can be undertaken and will suggest themselves to those skilled in the art without departing from the underlying principles and teachings of the present invention. For instance, it is conceivable to use instead of a continuous feed plate a plurality of smaller feed plates or pedals arranged next to one another, each of which is then appropriately structured to sense the force of the mass of fiber material acting thereupon and to generate a corresponding signal which is appropriately processed to produce the signals infed into the control which are then ultimately utilized for producing the controlled speed variations of the driven feed roll. Also the stops or abutments can be arranged at any desired locations such as at opposite ends or end regions of the feed plate which is to be immobilized.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method of determining the instantaneous thickness of fiber material at the infeed of a textile machine, comprising the steps of:

infeeding a mass of fiber material to a fiber infeed means possessing a nipping zone of essentially invariable size during operation of the fiber infeed means when determining the instantaneous thickness of the infed mass of fiber material;

passing the infed mass of fiber material through the essentially invariable size nipping zone; and deriving, during and as a result of the passage of the infed mass of fiber material through the essentially invariable size nipping zone, from the essentially invariable size nipping zone a signal representative of the instantaneous thickness of at least a part of the infed mass of fiber material passing through the essentially invariable size nipping zone.

2. The method as defined in claim 1, further including the step of:

utilizing fiber feed elements which are immobile in relation to one another during operation of the fiber infeed means in order to form the essentially invariable size nipping zone.

3. The method as defined in claim 2, wherein:

there are utilized as the fiber feed elements which are immobile in relation to one another a rotatable feed roll and a feed plate.

4. A method of determining the momentary thickness of fiber material at a textile machine, comprising the steps of:

infeeding a mass of fiber material to a fiber processing means possessing a fiber through pass zone of essentially unchanging size during operation of the fiber processing means when determining the momentary thickness of the infed mass of fiber material;

passing the infed mass of fiber material through the essentially unchanging size fiber through pass zone; and deriving from the passage of the infed mass of fiber material through the essentially unchanging size fiber throughpass zone, by means of the essentially unchanging size fiber through pass zone a signal indicative of the momentary thickness of at least a predeterminate part of the infed mass of fiber material passing through the essentially unchanging size fiber throughpass zone.

5. A method of detecting thickness variations of fiber material at the infeed of a textile machine, comprising the steps of:

infeeding a mass of fiber material to a fiber infeed means possessing a nipping zone having an essentially invariable size during operation of the fiber infeed means when detecting thickness variations of the mass of fiber material; and generating, as a consequence of the essentially invariable size nipping zone, signals representative of thickness variations of the throughpassing mass of fiber material during the throughpassage of the mass of fiber material through the essentially invariable size nipping zone.

6. The method as defined in claim 5, wherein:

the step of infeeding the mass of fiber material to the fiber infeed means possessing the nipping zone having an essentially invariable size during operation of the fiber infeed means when detecting thickness variations of the mass of fiber material entails bringing the mass of fiber material at the region of the essentially invariable size nipping zone into contact with fiber feed elements of the fiber infeed means and defining the essentially invariable size nipping zone.

7. The method as defined in claim 5, further including the steps of:

utilizing as the fiber infeed means a feed roll element and a feed element coacting with the feed roll element and defining therebetween the essentially invariable size nipping zone; and generating by means of one of said elements the signals representative of the thickness variations of the mass of fiber material passing through the essentially invariable size nipping zone.

8. The method as defined in claim 7, further including the steps of:

using as the feed element coacting with the feed roll element a feed plate; and maintaining said feed plate by the action of the throughpassing mass of fiber material in an immobile position to define the essentially invariable size nipping zone during detection of the thickness variations of the throughpassing mass of fiber material.

9. The method as defined in claim 7, further including the steps of:

using as the feed element a freely rotatable counter roll cooperating with the feed roll element; and maintaining the freely rotatable counter roll in an immobilized position to define the essentially invariable size nipping zone during throughpassage of the mass of fiber material.

10. The method as defined in claim 5, further including the steps of:

causing an air current to flow through the mass of fiber material located in the essentially invariable size nipping zone;

detecting the encountered resistance to the air flow of the air current by virtue of the mass of fiber material located within the essentially invariable size nipping zone; and generating said signals in dependence upon the encountered air flow resistance.

11. The method as defined in claim 5, further including the steps of:

feeding the mass of fiber material through the essentially invariable size nipping zone which includes a location of narrowest size; and generating the signals by virtue of the displacement of air from the mass of fiber material moving towards the narrowest size location of the essentially invariable size nipping zone.

12. The method as defined in claim 5, further including the steps of:

generating an air current by blowing in air through the mass of fiber material moving towards a narrowest size location of the essentially invariable size nipping zone;

detecting the encountered resistance to the flow of the air current by virtue of the mass of fiber material located within the essentially invariable size nipping zone; and generating said signals in dependence upon the encountered air flow resistance.

13. The method as defined in claim 5, further including the step of:

generating the signals as a function of resistance to air flow produced by at least part of the mass of fiber material located in the essentially invariable size nipping zone.

14. The method as defined in claim 5, further including the steps of:

utilizing as the fiber infeed means a feed roll element having a predeterminate length and a circumference and a feed element coacting with the feed roll element and defining therebetween the essentially invariable size nipping zone;

producing by means of one of said elements the generated signals representative of the thickness variations of the mass of fiber material passing through the essentially invariable size nipping zone; and the step of producing said generated signals entails passing the mass of fiber material through the essentially invariable size nipping zone such that a predeterminate portion of the mass of fiber material acts along a predeterminate extent of the essentially invariable size nipping zone and which predeterminate extent is defined by at least a predeterminate part of the predeterminate length of the feed roll element and a predeterminate part of the circumference of the feed roll element.

15. The method as defined in claim 5, further including the step of:

generating the signals by detecting forces produced by the throughpassing mass of fiber material and which are representative of the instantaneous density of at least predeterminate portions of the throughpassing mass of fiber material in the essentially invariable size nipping zone.

16. The method as defined in claim 15, further including the steps of:

transmitting the forces produced by the throughpassing mass of fiber material mechanically to force measuring means; and generating by means of the force measuring means electrical signals as the generated signals representative of the thickness variations of the throughpassing mass of fiber material in the essentially invariable size nipping zone.

17. The method as defined in claim 16, further including the steps of:

utilizing as the force measuring means strain gauge means to generate the electrical signals.

18. The method as defined in claim 15, further including the steps of:

transmitting the forces produced by the throughpassing mass of fiber material by fluid means to force measuring means; and generating electrical signals as the generated signals at the force measuring means.

19. The method as defined in claim 5, further including the step of:

feeding the mass of fiber material after moving through the essentially invariable size nipping zone to a carding machine constituting the textile machine.

20. The method as defined in claim 5, further including the step of:

feeding the mass of fiber material after moving through the essentially invariable size nipping zone to an open-end rotor spinning machine constituting the textile machine.

21. The method as defined in claim 5, further including the step of:

feeding the mass of fiber material after moving through the essentially invariable size nipping zone to an open-end friction spinning machine constituting the textile machine.

22. The method as defined in claim 7, especially for evening out the detected thickness variations of the mass of fiber material, further including the steps of:

feeding the generated signals into a control;

processing the signals in the control to obtain control signals; and utilizing the obtained control signals to control the rotational speed of the feed roll element.

23. The method as defined in claim 22, further including the steps of:

using as the feed element a feed plate having a nose portion at which there departs the mass of fiber material; and detecting the thickness variations of the throughpassing mass of fiber material at a location sufficiently near to the nose portion such that the feed roll substantially evens out the detected thickness variations at the region of the nose portion.

24. A method of detecting and correcting thickness variations of fiber material at the infeed of a textile machine, comprising the steps of:

infeeding a mass of fiber material to a fiber infeed means possessing a nipping zone having an essentially invariable size during operation of the fiber infeed means when detecting thickness variations of the mass of fiber material;

generating, as a result of the essentially invariable size nipping zone, signals indicative of thickness variations of the through passing mass of fiber material during the through passage of the mass of fiber material through the essentially invariable size nipping zone; and processing the generated signals to control throughfeed of the mass of fiber material through the essentially invariable size nipping zone in order to compensate detected thickness variations of the mass of fiber materials.

25. A method of determining the instantaneous thickness of fiber material at the infeed of a textile machine, comprising the steps of:

infeeding a mass of fiber material to a fiber infeed means possessing two operationally spatially fixedly positioned cooperating feed elements defining a nipping zone of essentially invariable size during operation of the fiber infeed means;

passing the infed mass of fiber material through the essentially invariable size nipping zone; and deriving from at least one of said two operationally spatially fixedly positioned cooperating feed elements during the passage of the infed mass of fiber material through the essentially invariable size nipping zone, a signal representative of the instantaneous thickness of at least a part of the infed mass of fiber material.

* * * * *

UNITED STATES PATENT AND TRADEMARK OFFICE

CERTIFICATE OF CORRECTION

PATENT NO. : 4,860,406

DATED : August 29, 1989

INVENTOR(S) : PAUL STäHELI et al

It is certified that error appears in the above-identified patent and that said Letters Patent is hereby corrected as shown below:

In the title, after "TEXTILE MACHINE" (second occurrence), please delete the redundant word --MACHINE--

In the abstract, line 3, after "this" please insert --feed--

Column 3, line 30, after "licker-in" please insert --cylinder or roll and in the opposite rotational sense or--

Column 17, line 18, after "the" (first occurrence), please insert --arrangement of Figures 10 and 11, the adjusting or adjustment--

Column 19, line 67, after "angle", please insert --α-- ("alpha")

Column 20, line 27, after "lap" please delete "is" and insert --15--

Column 20, line 65, after "transducer" please delete "52.2" and insert --53.2--

UNITED STATES PATENT AND TRADEMARK OFFICE

CERTIFICATE OF CORRECTION

PATENT NO. : 4,860,406

DATED : August 29, 1989

INVENTOR(S) : PAUL STäHELI et al

It is certified that error appears in the above-identified patent and that said Letters Patent is hereby corrected as shown below:

Column 21, line 33 after "fixedly" please insert --arranged in a machine housing portion or part 70. The spacing--

Signed and Sealed this

Eighth Day of January, 1991

*Attest:*

HARRY F. MANBECK, JR.

*Attesting Officer*

*Commissioner of Patents and Trademarks*